US009004675B2

(12) United States Patent
Miller et al.

(10) Patent No.: US 9,004,675 B2
(45) Date of Patent: Apr. 14, 2015

(54) IMAGE CORRECTION WITH 3D PRINTING

(71) Applicant: NIKE, Inc., Beaverton, OR (US)

(72) Inventors: Todd W. Miller, Portland, OR (US); David J. Schenone, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/230,106

(22) Filed: Mar. 31, 2014

(65) Prior Publication Data

US 2014/0300676 A1 Oct. 9, 2014

Related U.S. Application Data

(60) Provisional application No. 61/808,543, filed on Apr. 4, 2013.

(51) Int. Cl.
*B41J 3/407* (2006.01)
*B41F 17/38* (2006.01)

(52) U.S. Cl.
CPC ..... *B41F 17/38* (2013.01); *B41J 3/4073* (2013.01); *B41J 3/4078* (2013.01)

(58) Field of Classification Search
USPC ..... 347/16, 101, 102, 104–108
See application file for complete search history.

(56) References Cited

U.S. PATENT DOCUMENTS

| | | | | |
|---|---|---|---|---|
| 3,458,614 | A | 7/1969 | Knoll | |
| 4,817,315 | A | 4/1989 | Kammerer et al. | |
| 4,956,906 | A | 9/1990 | Masse et al. | |
| 5,277,110 | A | 1/1994 | Scherp | |
| 5,458,590 | A * | 10/1995 | Schleinz et al. | 347/106 |
| 6,354,029 | B1 | 3/2002 | Chenel | |
| 6,677,065 | B2 | 1/2004 | Blauer | |
| 6,824,839 | B1 * | 11/2004 | Popat et al. | 347/105 |
| 7,555,157 | B2 | 6/2009 | Davidson et al. | |
| 7,881,818 | B2 | 2/2011 | Van Bael et al. | |
| 7,992,994 | B2 * | 8/2011 | Kobayashi et al. | 347/107 |
| 8,003,927 | B2 | 8/2011 | Kondo et al. | |
| 8,348,371 | B2 * | 1/2013 | McDowell et al. | 347/104 |
| 2005/0146073 | A1 | 7/2005 | Guloy | |
| 2006/0108704 | A1 | 5/2006 | Geiwald et al. | |
| 2009/0189917 | A1 | 7/2009 | Benko et al. | |
| 2011/0041239 | A1 * | 2/2011 | Altig | 347/104 |
| 2013/0027723 | A1 * | 1/2013 | Coyle | 347/101 |

FOREIGN PATENT DOCUMENTS

| | | | |
|---|---|---|---|
| JP | 2010-059563 | A | 3/2010 |
| WO | 2004/007203 | A1 | 1/2004 |

OTHER PUBLICATIONS

International Search Report and Written Opinion mailed Aug. 29, 2014 in PCT/US2014/032519.

* cited by examiner

*Primary Examiner* — Kristal Feggins
(74) *Attorney, Agent, or Firm* — Plumsea Law Group, LLC

(57) ABSTRACT

Methods and systems are disclosed for three-dimensional printing directly onto an article of apparel. Disclosed is a method and system for direct three-dimensional printing onto an article of apparel, including receiving an undistorted three-dimensional pattern for display on the article, the undistorted three-dimensional pattern configured for placement on an irregular three-dimensional surface; creating a predistorted three-dimensional pattern from the undistorted three-dimensional pattern for printing onto a simple three-dimensional shaped object; receiving the predistorted three-dimensional pattern in a three-dimensional printing system; and printing the predistorted three-dimensional pattern onto the article.

27 Claims, 16 Drawing Sheets

IMAGE CORRECTION WITH 3D PRINTING

CROSS-REFERENCE TO RELATED APPLICATION

This non-provisional patent application is a continuation of and claims priority to U.S. Provisional Patent Application Ser. No. 61/808,543, which was filed in the U.S. Patent and Trademark Office on 4 Apr. 2013 and entitled Image Correction with 3D Printing, the disclosure of which is incorporated in its entirety by reference.

TECHNICAL FIELD

This disclosure relates generally to the field of three-dimensional ("3D") printing onto an article of apparel, footwear, or equipment, and more specifically to methods and systems for 3D printing directly onto fabric apparel materials.

SUMMARY OF INVENTION

Methods and systems are disclosed for three-dimensional printing directly onto an article of apparel. Disclosed is a method and system for direct three dimensional printing onto an article of apparel, including receiving an undistorted three-dimensional pattern for display on the article, the undistorted three-dimensional pattern configured for placement on an irregular three-dimensional surface; creating a predistorted three-dimensional pattern from the undistorted three-dimensional pattern for printing onto a simple three-dimensional shaped object; receiving the predistorted three-dimensional pattern in a three dimensional printing system; and printing the predistorted three-dimensional pattern onto the article.

In one aspect, the invention provides a method of three-dimensional printing onto an article of apparel that includes the steps of (1) receiving an undistorted three-dimensional pattern for display on the article, the undistorted three-dimensional pattern configured for placement on an irregular three-dimensional surface; (2) creating a predistorted three-dimensional pattern from the undistorted three-dimensional pattern for printing onto a simple three-dimensional shaped object; (3) receiving the predistorted three-dimensional pattern in a three-dimensional printing system; and (4) printing the predistorted three-dimensional pattern onto the article.

In another aspect, the invention provides a method of three-dimensional printing onto an article of apparel. The method includes the steps of (1) receiving an undistorted three-dimensional pattern for display on the article, the undistorted three-dimensional pattern configured for placement on at least a portion of a human body; (2) creating a predistorted three-dimensional pattern from the undistorted three-dimensional pattern for printing onto a three-dimensional geometric primitive object; (3) receiving the predistorted three-dimensional pattern in a three-dimensional printing system; and (4) printing the predistorted three-dimensional pattern onto the article.

A method of three-dimensional printing onto an article of apparel, comprising the steps of: (1) receiving, in a computing device, an undistorted three-dimensional pattern for display on the article, the undistorted three-dimensional pattern configured for placement on at least a portion of a human body; (2) creating, using the computing device, a predistorted three-dimensional pattern from the undistorted three-dimensional pattern for printing onto a three-dimensional geometric primitive object; (3) receiving the predistorted three-dimensional pattern to a three-dimensional printing system; and (4) printing the predistorted three-dimensional pattern onto the article.

A method of three-dimensional printing onto an article of apparel, the method comprising the steps of: (1) receiving, in a computing device, an undistorted three-dimensional pattern for display on the article, the undistorted three-dimensional pattern configured for placement on at least a portion of a human body, at least a portion of the undistorted three-dimensional pattern having at least a first arc length; (2) creating, using the computing device, a predistorted three-dimensional pattern from the undistorted three-dimensional pattern for printing onto a three-dimensional geometric primitive object, at least a portion of the predistorted three-dimensional pattern having at least a second arc length; (3) receiving the predistorted three-dimensional pattern in a three-dimensional printing system; and (4) printing at least a portion of the second arc length of the predistorted three-dimensional pattern onto the article disposed on the three-dimensional geometric primitive object.

A system for three-dimensional printing onto an article of apparel comprises a three-dimensional printing device and at least one computer system. The three-dimensional printing device is in direct communication with the at least one computer system. The at least one computer system is configured to receive an undistorted three-dimensional pattern for display on the article, wherein the undistorted three-dimensional pattern is configured for placement on at least a portion of a human body, and wherein at least a portion of the undistorted three-dimensional pattern has at least a first arc length. The at least one computer system creates a predistorted three-dimensional pattern from the undistorted three-dimensional pattern for printing onto a three dimensional geometric primitive object. At least a portion of the predistorted three-dimensional pattern has at least a second arc length. The three-dimensional printing device comprises a rotatable cylinder for receiving the article and at least one printing head for printing onto the article. The three-dimensional printing device prints at least a portion of the second arc length of the predistorted three-dimensional pattern onto the article disposed on the three-dimensional geometric primitive object.

BRIEF DESCRIPTION OF THE DRAWINGS

The accompanying drawings, which are incorporated in and constitute a part of this specification, illustrate embodiments and, together with the description, serve to explain the features, advantages, and principles of the embodiments disclosed throughout this disclosure. For illustration purposes, the following drawings may not be to scale. Moreover, like reference numerals designate corresponding parts throughout the different views. In the drawings.

DETAILED DESCRIPTION

Figure 1:
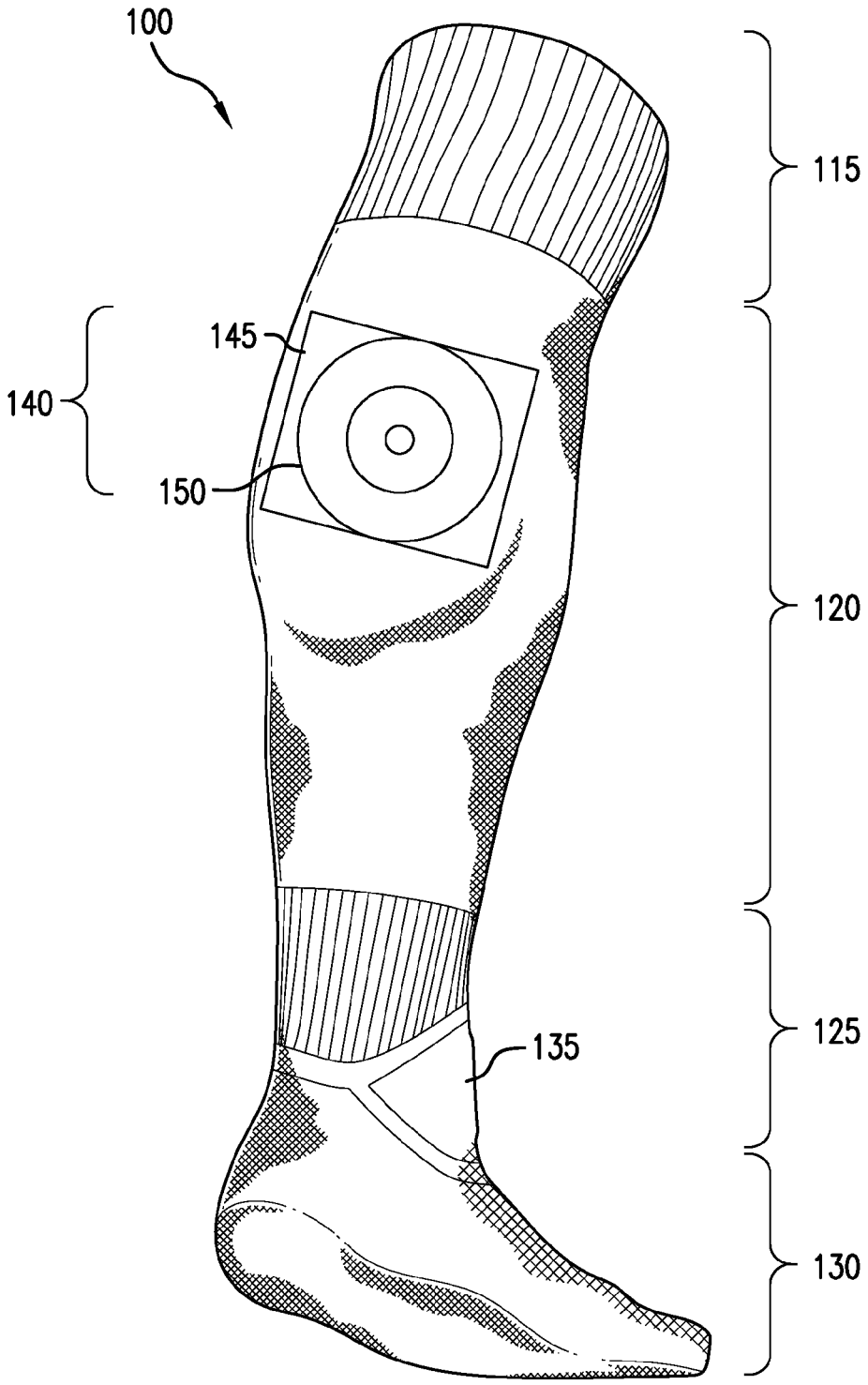
FIG. 1 shows a perspective view of a fabric sock on a wearer and having an undistorted 3D image printed thereon, consistent with an embodiment of the disclosure.

The following discussion and accompanying figures disclose methods and systems for 3D printing onto a fabric material. In particular, an exemplary method is disclosed comprising printing of a predistorted 3D pattern onto regular or simple 3D surface of a fabric to achieve an undistorted appearance of the printed 3D pattern when the fabric is presented on another, irregular, 3D surface, such as an individual's leg for use in apparel applications. The disclosed methods and systems may use any suitable 3D printing system.

As used throughout this disclosure, the terms "three-dimensional printing system," "three-dimensional printer," "3D printing system," and "3D printer" refer to any known 3D printing system or printer. Contrary to known 3D printing methods, however, the disclosed methods and systems accomplish 3D printing of a predistorted image or pattern directly onto any regular or simple 3D surface of a textile, a natural fabric, a synthetic fabric, a knit, a woven material, a nonwoven material, a mesh, a leather, a synthetic leather, a polymer, a rubber, and a foam, or any combination of them. For example, such a regular or simple 3D surface may be a cylinder. For example, the disclosed methods may include printing of any material, for example an ink, dye, resin, or acrylic onto a fabric, for example a knit material, where the material is absorbed into, adhered to, or bonded to the fabric and where the material does not generally delaminate from the fabric when flexed, rolled, worked, or subject to additional assembly processes or steps. As used throughout this disclosure, the term "fabric" may be used to refer generally to materials chosen from any textile, natural fabric, synthetic fabric, knit, woven material, nonwoven material, mesh, leather, synthetic leather, polymers, rubbers, and foam, and may also be used to refer to any natural or synthetic fiber or material, such as, for example, cotton, wool, linen, silk, nylon, elastane (i.e., spandex), polyester, rayon, and olefins (i.e., polypropylene), and may further comprise combinations of any of these materials. Also as used throughout this disclosure, the terms "printing" or "printed," and "depositing" or "deposited," are each used synonymously, and are intended to refer to the association of a material from a source of the material to a receiving surface or object.

Consistent with an embodiment, an exemplary article of apparel is disclosed as a sock. As used throughout this disclosure, the terms "article of apparel" and "fabric" include any textile and any materials associated with or made from fabric, including a sock, and may also be applied to any article of clothing, apparel, or equipment. For example, the disclosed embodiments may be applied to hats, caps, shirts, jerseys, jackets, socks, shorts, pants, undergarments, athletic support garments, gloves, wrist/arm bands, sleeves, headbands, any knit material, any woven material, any nonwoven material, sports equipment, etc. Thus, as used throughout this disclosure, the term "article of apparel" may refer to any apparel or clothing, including hats, caps, shirts, jerseys, jackets, socks, shorts, pants, undergarments, athletic support garments, gloves, wrist or arm bands, sleeves, headbands, any knit material, any woven material, any nonwoven material, etc.

In accordance with the systems and methods described throughout this disclosure, there is provided a method of three-dimensional printing onto an article of apparel, comprising: receiving an undistorted three-dimensional pattern for display on the article, the undistorted three-dimensional pattern configured for placement on an irregular three-dimensional surface; creating a predistorted three-dimensional pattern from the undistorted three-dimensional pattern for printing onto a simple three-dimensional shaped object; receiving the predistorted three-dimensional pattern in a three dimensional printing system; and printing the predistorted three-dimensional pattern onto the article.

In accordance with the systems and methods described throughout this disclosure, there is also provided a method of three-dimensional printing onto an article of apparel, comprising: receiving an undistorted three-dimensional pattern for display on the article, the undistorted three-dimensional pattern configured for placement on at least a portion of a human body; creating a predistorted three-dimensional pattern from the undistorted three-dimensional pattern for printing onto a three-dimensional geometric primitive object; receiving the predistorted three-dimensional pattern in a three-dimensional printing system; and printing the predistorted three-dimensional pattern onto the article.

In accordance with the systems and methods described throughout this disclosure, there is provided a method of three-dimensional printing onto an article of apparel, comprising: receiving, in a computing device, an undistorted three-dimensional pattern for display on the article, the undistorted three-dimensional pattern configured for placement on at least a portion of a human body; creating, using the computing device, a predistorted three-dimensional pattern from the undistorted three-dimensional pattern for printing onto a three dimensional geometric primitive object; receiving the predistorted three-dimensional pattern to a three-dimensional printing system; and printing the predistorted three-dimensional pattern onto the article.

In accordance with the systems and methods described throughout this disclosure, there is provided a method of three-dimensional printing onto an article of apparel, comprising: receiving, in a computing device, an undistorted three-dimensional pattern for display on the article, the undistorted three-dimensional pattern configured for placement on at least a portion of a human body, at least a portion of the undistorted three-dimensional pattern having at least a first arc length; creating, using the computing device, a predistorted three-dimensional pattern from the undistorted three-dimensional pattern for printing onto a three dimensional geometric primitive object, at least a portion of the predistorted three-dimensional pattern having at least a second arc length; receiving the predistorted three-dimensional pattern in a three-dimensional printing system; and printing at least a portion of the second arc length of the predistorted three dimensional pattern onto the article disposed on the three-dimensional geometric primitive object.

In accordance with the systems and methods described throughout this disclosure, there is provided a system for three-dimensional printing onto an article of apparel, comprising: a three-dimensional printing device; and at least one computer system, wherein the three dimensional printing device is in direct communication with the at least one computer system, wherein the at least one computer system receives an undistorted three-dimensional pattern for display on the article, the undistorted three dimensional pattern configured for placement on at least a portion of a human body, at least a portion of the undistorted three-dimensional pattern having at least a first arc length, wherein the at least one computer system creates a predistorted three-dimensional pattern from the undistorted three-dimensional pattern for printing onto a three dimensional geometric primitive object, at least a portion of the predistorted three-dimensional pattern having at least a second arc length, wherein the three-dimensional printing device comprises a rotatable cylinder for receiving the article, and at least one printing head for printing onto the article, and wherein the three-dimensional printing device prints at least a portion of the second arc length of the predistorted three dimensional pattern onto the article disposed on the three-dimensional geometric primitive object.

Additional features and advantages will be set forth in part in the description that follows, being apparent from the description or learned by practice of embodiments. Both the foregoing description and the following description are exemplary and explanatory, and are intended to provide further explanation of the embodiments as claimed.

One or more articles of apparel, such as athletic socks that may be worn by soccer players, often display colorful and complex patterns and images on one or more parts of the apparel. For example, team logos, national flags, designs, or other identifying or individualizing characteristics may be displayed on the apparel. Additionally, the apparel is designed to provide comfort, cushion, support, and protection to the wearer. As such, the apparel is subject to tremendous wear-and-tear, such as stretching, twisting, and any other manner of compressive, tensile, or torsional forces. For example, even the act of putting a sock onto the irregular three-dimensional shape of a person's foot and leg forces the sock to conform to the irregular three-dimensional shape of the wearer. Moreover, various inserts between the sock and the wearer, such as padding or protective materials (such as shin guards), requires that the sock hold the padding or protective materials in place as well as to conform to the irregular three-dimensional shape of the wearer. Thus, the irregular three-dimensional shape of the wearer, as well as any padding or protective materials, imparts nonuniform stretching to various portions of the sock due to bone, muscle, and ligament structures of the wearer.

It is desired that displayed patterns and images, such as team logos, national flags, designs, or other identifying or individualizing characteristics be displayed on the socks or other articles of apparel such that the intended identifying or individualizing characteristics appear recognizable and without distortion due to the nonuniform stretching of various portions of the sock upon wearing on an irregular three-dimensional surface.

Consistent with an embodiment, an article of apparel 100, throughout this disclosure referred to simply as apparel 100, or for example as sock 100, is depicted in FIG. 1 on a wearer and as including an upper portion 115, a middle or calf portion 120, a lower or ankle portion 125, and a foot portion 130. For reference purposes, apparel 100 may be divided into these four general portions. Upper portion 115 generally includes, for example, a ribbed knit material designed to stretch and provide uniform compressive force around the wearer's leg below the knee, such that upper portion 115 serves to aid in holding the sock in place on the wearer during physical activity, while aiding in prevention of sliding of the sock down the wearer's leg. Middle or calf portion 120 generally includes, for example, a knit material designed to cover the wearer's calf and shin, and provide comfort and support to the muscles and skin in this region, as well as to hold any protective material (such as shin guards) in place on the wearer's leg. Lower or ankle portion 125 generally includes, for example, a knit material designed to cover the wearer's ankle and more generally to cover a transitional area between the wearer's calf and foot. Portion 125 may include, for example, one or more ankle pads 135. Foot portion 130 generally includes, for example, a knit material designed to cover the wearer's foot and provide comfort and support to the muscles and skin in this region.

One or more of these four general portions of apparel 100 may comprise knit material of varying thickness, stretchiness, or strength, and may also comprise padded regions. For example, apparel 100 may include one or more pads, such as ankle pad 135, which may comprise a thicker portion of fabric designed to protect one or more regions of the wearer's body such as ankle portion 125. Apparel 100 may comprise any suitable fabric or material for sock or apparel applications, such as a knit material or a woven material, and may comprise any natural or synthetic fiber or material in its construction, such as, for example, cotton, wool, linen, silk, nylon, elastane (i.e., spandex), polyester, rayon, and olefins (i.e., polypropylene), and may further comprise combinations of any of these materials. Likewise, types of apparel 100 may comprise socks, jackets, pants, caps as well as any other items of apparel with one or more sections that can be flexible, curved, stretched, or that have portions that can be encircled (i.e., sleeves).

The percentage of area of apparel 100 occupied by each of upper portion 115, middle or calf portion 120, lower or ankle portion 125, and foot portion 130 may vary depending on the apparel, intended use, or construction of apparel 100. For example, upper portion 115 may comprise a relatively small percentage of the overall sock length as depicted in FIG. 1, or upper portion 115 may comprise a large percentage of the overall sock length. Likewise, for example, middle or calf portion 120, and lower or ankle portion 125, may also comprise larger or smaller percentages of the length of apparel 100 than actually depicted in FIG. 1. Area percentage of each of the four generally described sections of apparel 100 may vary according to the design and intended use of the apparel without departing from the scope and spirit of the disclosure.

Consistent with an embodiment, apparel 100 may also include one or more printed 3D patterns or designs 140. Pattern 140, while shown over the wearer's calf muscle region in FIG. 1, may be located on any region, or multiple regions, including any or all of the four general portions of apparel 100 described above. Pattern 140 is shown for simplicity purposes in FIG. 1 as a 3D depiction comprising a rectangle 145 and an inset arrangement of one or more circles 150, displayed without distortion on the wearer's calf on middle portion 120. Again, pattern 140, while shown in FIG. 1 as rectangle 145 and circles 150, may instead comprise any desired image, shape, or pattern, such as team logos, national flags, designs, or any other identifying or individualizing characteristics desired by the wearer. Consistent with an embodiment, however, and contrary to what is known in the art, pattern 140 manifests itself in an undistorted manner on apparel 100 when worn on the irregular three-dimensional shape of the wearer and is depicted as such in FIG. 1. Thus, pattern 140 shown in FIG. 1 appears recognizable and without distortion despite the nonuniform stretching of various portions of apparel 100 upon wearing, with or without underlying padding or protective materials.

Consistent with an embodiment, pattern 140 may be a printed material applied to apparel 100, and may comprise any printed material, including for example an ink, a dye, a resin, an acrylic, a polymer, a thermoplastic material, a thermosetting material, a light-curable material, or combinations thereof. Also consistent with an embodiment, pattern 140 may be a printed material applied to apparel 100 in one or more layers over a sequence of depositions of material to any desired thickness, and may or may not include a filler material to impart a strengthening or aesthetic aspect to pattern 140. For example, pattern 140 may comprise any printed material designed to impart any desired color, colors, and color patterns or transitions, and may include any materials such as metallic or plastic particles or shavings, or any other powdered mineral, metal, or plastic, to customize the hardness, strength, or elasticity of pattern 140 depending on desired properties. Consistent with an embodiment, pattern 140 may thus simply be a printed dye, or it may be a composite material, printed onto apparel 100.

Figure 2:
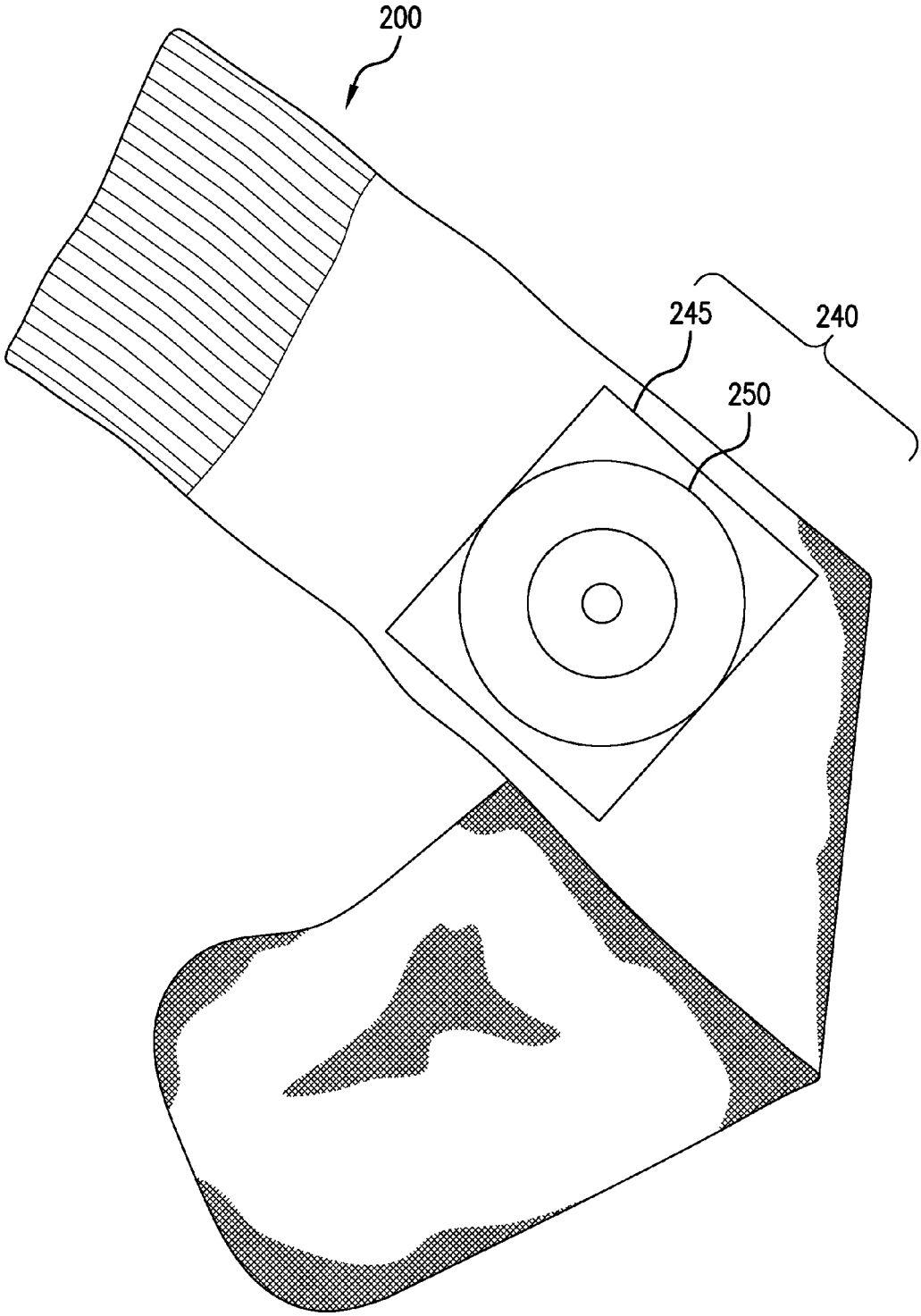
FIG.2 (PRIOR ART)
FIG. 2 shows an elevated view of a conventional athletic sock disposed flat and folded over to show an undistorted image thereon.

Referring to FIG. 2, a conventional athletic sock 200 is shown disposed flat and folded over on itself. Conventional sock 200 may include a pattern 240 depicted thereon. For simplicity, pattern 240 is shown comprising a rectangle 245 and an inset arrangement of one or more circles 250, which are displayed without distortion when conventional sock 200 is not being worn. Pattern 240 thus manifests itself in an undistorted manner on conventional sock 200 only in the unworn and approximately two-dimensional and relaxed state of its material.

Figure 3:
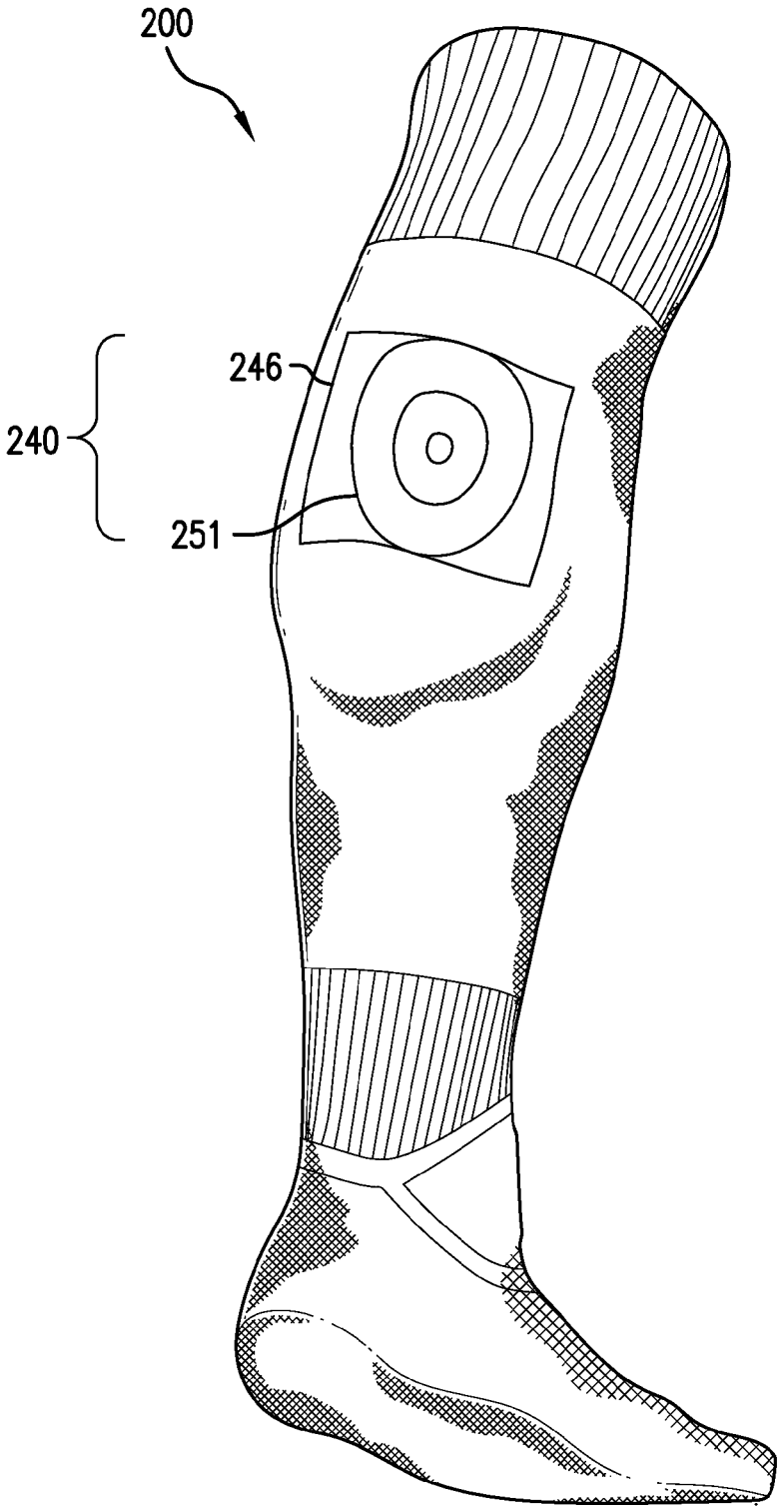
FIG.3 (PRIOR ART)
FIG. 3 shows perspective view of a conventional athletic sock on a wearer and having a distorted image thereon.

In contrast to the relaxed state of material of conventional sock 200 in FIG. 2, FIG. 3 illustrates conventional sock 200 on a wearer. While pattern 240 may appear undistorted on conventional sock 200 when unworn as shown in FIG. 2, pattern 240 instead manifests noticeable distortion when conventional sock 200 is worn as shown in FIG. 3. As shown in FIG. 3, pattern 240 comprises a distorted rectangle 246 and an inset arrangement of one or more distorted circles 251, which are distorted due to the wearing and stretching of conventional sock 200 on the irregular three-dimensional shape of the wearer. Thus, the nonuniform stretching of various portions of conventional sock 200 upon wearing causes undesirable distortion like that manifested in pattern 240.

Figure 4:
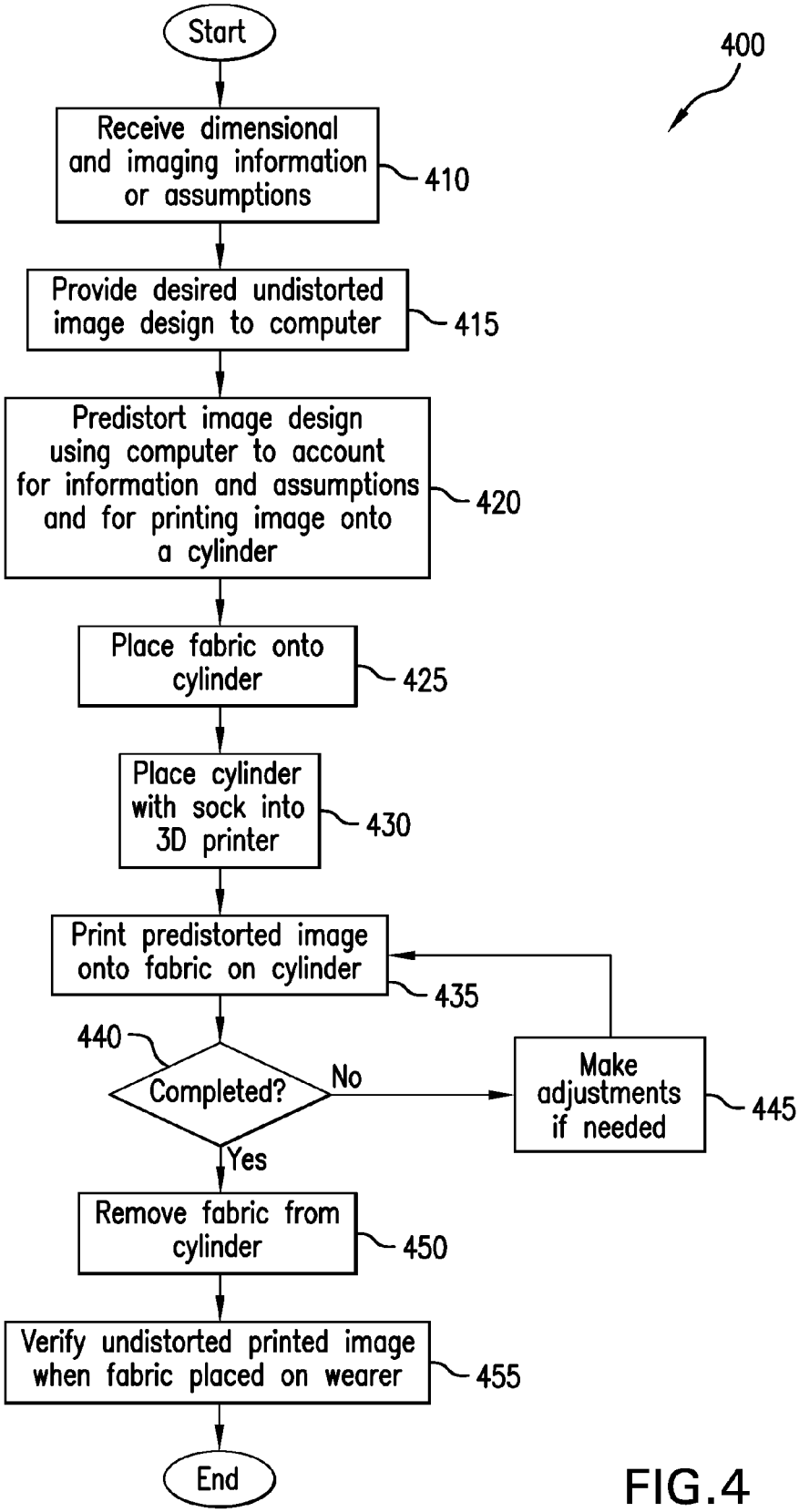
FIG. 4 shows a process for 3D printing onto a fabric, consistent with an embodiment of the disclosure.

As shown in FIG. 4, exemplary process 400 for 3D printing onto article of apparel 100 begins with step 410. It will be appreciated that some or all steps in process 400 may be completed by a footwear, apparel, or equipment manufacturer or proprietor. In other cases, some steps described below may be accomplished by a manufacturer and other steps may be accomplished by another party including another manufacturer, proprietor, retailer, or any other entity. In some cases, one or more of the steps may be optional. In other cases, some steps may be completed in a different order. Still referring to FIG. 4, in step 410, a computer (such as computing device 700 described later with reference to FIGS. 7 and 8) may receive information useful in developing a design for an undistorted three-dimensional pattern for display on article 100 when the article is placed on an irregular three-dimensional surface. Such information may be dimensional and imaging information or assumptions (such as length and curvature measurements 510 from a wearer's leg 500, and corresponding dimensional measurements from sock 600, described later with reference to FIGS. 5 and 6, respectively).

In step 415, the computer (such as computing device 700 described later with reference to FIG. 7) may be used to design the undistorted three-dimensional pattern for display on article 100 when the article is placed on an irregular three-dimensional surface, based at least in part on the information received in step 410. The desired undistorted image design may thus be provided to the computer.

In step 420, the computer (such as computing device 700 described later with reference to FIG. 8) may be used to calculate and display a predistorted three-dimensional pattern from the undistorted three-dimensional pattern for printing onto a simple three-dimensional shaped object, also based at least in part on the information received in step 410 and the designed undistorted three-dimensional pattern provided in step 415. For example, computing device 700 may be used to calculate and display a predistorted three-dimensional pattern for printing onto the simple three-dimensional shape of a cylinder, as shown and described later with respect to FIG. 8, and as also described later with reference to FIGS. 9-18. The calculated and displayed predistorted three-dimensional pattern takes into account the distortions in sock 100 and hence printed pattern 140 that will manifest themselves when sock 100 is placed on wearer's leg 500. That is, the predistorted three-dimensional pattern (for example, pattern 850 shown and described later with reference to FIG. 8, and printed pattern 1100 shown and described later with reference to FIG. 15) will itself undergo distortion upon placement on wearer's leg 500. That distortion will alter the printed pattern into the desired undistorted shape, such as undistorted three-dimensional pattern 140 shown as described with reference to FIGS. 1, 17, and 18.

In step 425, a fabric material such as sock 100 may be placed on a cylinder (such as cylinder 920 described later with reference to FIGS. 9-10) and positioned in a 3D printer device (such as 3D printer device 1000 described later with reference to FIGS. 11-14). In step 425, fabric material such as sock 100 may be positioned to facilitate accurate printing of any desired predistorted three-dimensional pattern onto the simple three-dimensional surface of the cylinder. In step 430, the fabric material such as sock 100 placed on the cylinder is then placed in the 3D printer device and positioned for printing as described later with reference to FIG. 12.

In step 435, the 3D printer device executes printing onto fabric material such as sock 100, using the predistorted three-dimensional pattern calculated from the undistorted three-dimensional pattern and dimensional information gathered and provided by the computer. As discussed above, printing may include printing of an ink, dye, resin, or acrylic material onto a fabric, where the material is absorbed into, adhered to, or bonded to the fabric and where the material does not generally delaminate when flexed, rolled, worked, or subject to additional assembly processes or steps. Consistent with an embodiment, the printed material printed according to step 435 may be an ink, dye, resin, acrylic, polymer, thermoplastic material, thermosetting material, light-curable material, or combinations thereof. The printed material may also include a filler material to impart a strengthening or aesthetic aspect to the printed material in one or more printed layers. Consistent with an embodiment, the printed material printed in step 435 may simply be an ink or dye, or may be a composite material.

In step 440, progress of 3D printing may be periodically evaluated. For example, one may evaluate the progress of printing after one or more layers of material are printed, as shown and described later, for example, in FIG. 15.

In step 445, if desired printing is not complete, or if adjustments are desired during printing, fabric material such as sock 100 may be repositioned on the cylinder, or the cylinder may be removed and reinserted into the 3D printer device to continue printing, whereby the process may proceed back to step 435.

In step 450, if desired printing is complete, fabric material such as sock 100 may be removed from the 3D printer device and removed from the cylinder, as shown and described later with respect to FIG. 16. Also in step 450, upon removal of sock 100 from the cylinder, the printed predistorted three-dimensional image may appear even more distorted than the predistorted three-dimensional image 850 originally calculated and displayed on computing device 700 shown in FIG. 8. This is because the fabric of the sock will relax and shrink after release from being stretched around the cylinder during printing. This additional distortion will have been accounted for by computing device 700 in step 420, such that the image displayed on the sock when subsequently worn will have no apparent distortion. In step 455, accurate three-dimensional printing may thus be verified by placing sock 100 on the irregular three-dimensional surface of a wearer to display the undistorted three-dimensional pattern, as shown and described later with respect to FIGS. 17-18.

Figure 5:
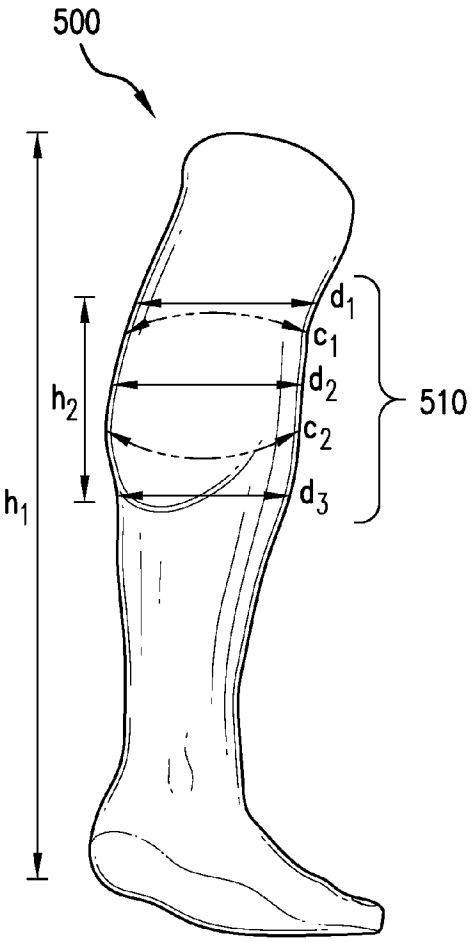
FIG. 5 shows a perspective view of a portion of an individual's leg and foot, indicating dimensional and imaging information for 3D printing, consistent with an embodiment of the disclosure.

A method of three-dimensional printing onto an article of apparel will now be further described with reference to FIGS. 5-18. Consistent with an embodiment, FIG. 5 shows a bare portion of a wearer's leg 500. In order to aid in calculating and designing a predistorted image for three-dimensional printing onto apparel 100, dimensional information may be gathered from wearer's leg 500 in the portion or portions where the desired undistorted three-dimensional pattern is intended for printing and display. For example, as shown in FIG. 5, one or more measurements may be taken from wearer's leg 500, such as distance measurements D1, D2, and D3, height measurements H1 and H2, and curvature or arc length measurements C1 and C2. Additional measurements, less measurements, images, three-dimensional mapping, or other techniques may or may not be used to gather data and other dimensional information from wear's leg 500. Such information, in whatever form and amount, may be used to aid in adequate and accurate predicting of the manifestation of a desired undistorted three-dimensional pattern or image on a surface of wearer's leg 500, taking into account any and all three-dimensional surface irregularities and asymmetries that may be present thereon.

Figure 6:
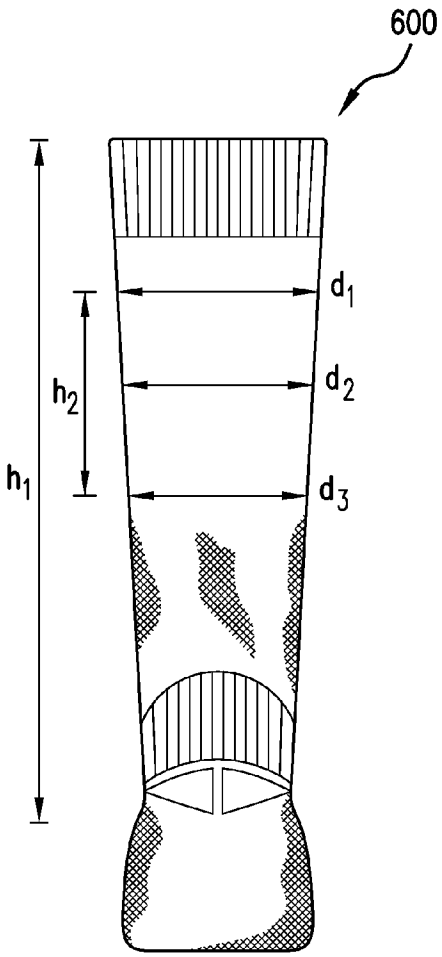
FIG. 6 shows an overhead perspective view of a fabric sock disposed flat and indicating dimensional and imaging information for 3D printing, consistent with an embodiment of the disclosure.

Consistent with an embodiment, FIG. 6 shows a sock 600 disposed flat and without any printing thereon. Sock 100 may be consistent with apparel 100 shown in FIG. 1, but in the preprinted state. As shown in FIG. 6, dimensional information may also be gathered from sock 600 in the portion or portions where the desired undistorted three-dimensional pattern is intended for printing and display and where the predistorted and printed three-dimensional pattern or image will appear after printing and prior to wearing sock 600. For example, as shown in FIG. 6, one or more additional measurements may be taken from sock 600, such as distance measurements D1, D2, and D3, and height measurements H1 and H2. Additional measurements, less measurements, images, three-dimensional mapping, or other techniques may or may not be used to gather data and other dimensional information from sock 600. For example, data may also be gathered as to the type of material comprising sock 600, how much the material will stretch or yield to externally applied forces, and surface texture, among other things. Such information, in whatever form and amount, may be used to aid in adequate and accurate predicting of the manifestation of a desired undistorted three-dimensional pattern or image on a surface of wearer's leg 500, taking into account any and all aspects of sock 600 prior to being placed on wearer's leg 500.

Figure 7:
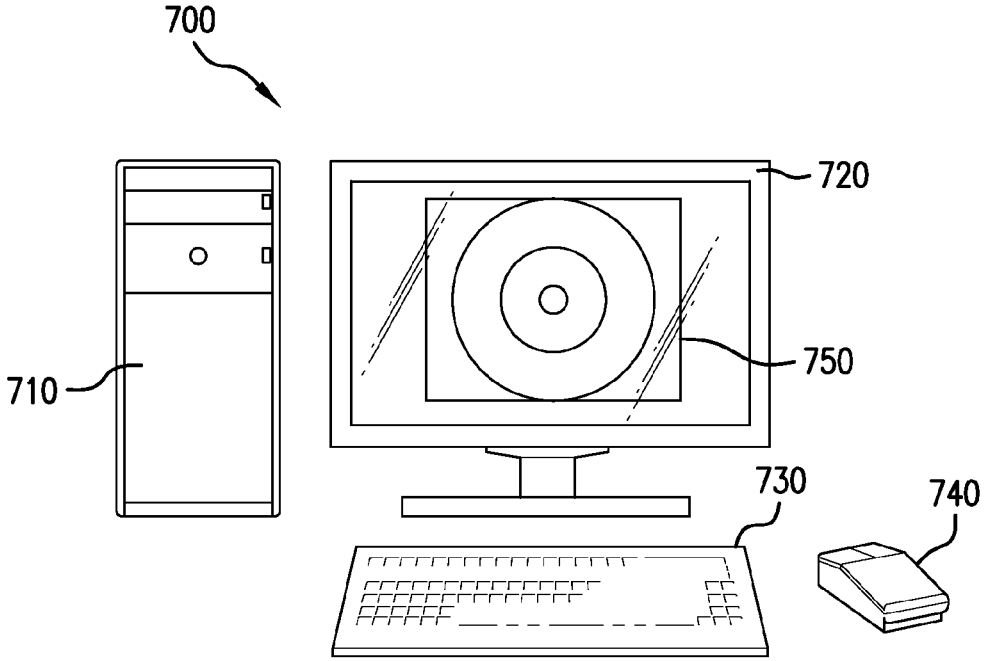
FIG. 7 shows a schematic view of a computing device displaying an undistorted 3D image desired for printing onto a fabric, consistent with an embodiment of the disclosure.

Consistent with an embodiment, FIG. 7 shows a computing device 700 used for designing an undistorted three-dimensional pattern for display on the article when the article is placed on an irregular three-dimensional surface, and for calculating a predistorted three-dimensional pattern from the undistorted three-dimensional pattern for printing onto a simple three-dimensional shaped object. Computing device 700 may also be described as a print server, in that it may also direct or control the three-dimensional printing of 3D printer 1000 (shown and described later with reference to FIGS. 11-14). Computing device 700 may comprise a central processing device 710, viewing interface 720 (e.g., a monitor or screen), input devices 730 and 740 (e.g., keyboard and mouse), and software for designing a computer-aided design ("CAD"), three-dimensional mapping, or other representation of desired undistorted three dimensional pattern or image 750, intended for display on apparel 100 as depicted on viewing interface 720.

The term "computer," "computing device," or "print server," as used throughout the disclosure, means a single computer, the partial computing resources of a computer, or two or more computers communicating with each other. Still referring to FIG. 7, computing device 700 may thus include one or more first nontransitory computer-readable media in central processing device 710 encoded with a first computer program product loadable into a memory of computing device 700 and include one or more software code portions for instructing the three-dimensional printing device to print, through a sequence of printing steps, a predistorted three-dimensional pattern calculated from the undistorted three-dimensional pattern. Consistent with an embodiment, computing device 700 may be used to prepare computer-aided design ("CAD"), three-dimensional mapping, or other representation of a desired undistorted three dimensional pattern or image 750 for display or manifestation on any desired irregular three-dimensional surface. Portions of computing device 700 may be omitted in some embodiments, or additional portions or components may be included.

Still referring to FIG. 7, computing device 700 may be in direct communication with 3D printer 1000 (shown and described in later referring to FIGS. 11-14). Moreover, computing device 700 may also include one or more second nontransitory computer-readable media encoded with a second computer program product loadable into a memory of computing device 700 or 3D printer 1000 and include second software code portions for instructing 3D printer 1000 to print, through a sequence of printing steps, a predistorted three-dimensional pattern calculated from the undistorted three-dimensional pattern. Consistent with an embodiment, 3D printer 1000 may require computing device 700 for implementation of printing, or may operate independently of computing device 700 during 3D printing.

Figure 8:
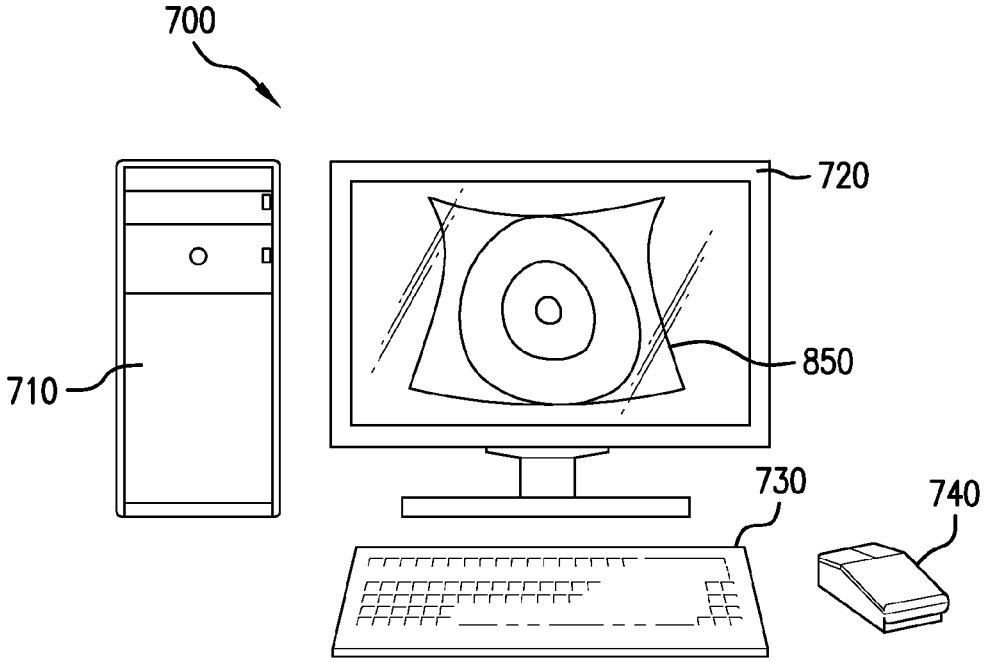
FIG. 8 shows a schematic view of a computing device displaying a predistorted 3D image for printing onto a fabric placed on a cylinder, consistent with an embodiment of the disclosure.

Consistent with an embodiment, FIG. 8 shows computing device 700 displaying a predistorted three-dimensional pattern or image 850 calculated and transformed from the undistorted three dimensional pattern or image 750 shown in FIG. 7. In calculating and transforming the undistorted three-dimensional pattern 750 into the distorted three-dimensional pattern 850, computing device 700 may take into account one or more measurements taken from wearer's leg 500 shown in FIG. 5, such as distance measurements D1, D2, and D3, height measurements H1 and H2, and curvature measurements C1 and C2. Additional measurements, less measurements, images, three-dimensional mapping, or other techniques may or may not be used by computing device 700 to gather data and other dimensional information from wear's leg 500. Such information, in whatever form and amount, may be used to aid in adequate and accurate predicting of the manifestation of a desired undistorted three-dimensional pattern or image on a surface of wearer's leg 500, taking into account any and all three-dimensional surface irregularities and asymmetries that may be present thereon.

Still referring to FIG. 8, and consistent with an embodiment, computing device 700 may also take into account dimensional information gathered from sock 600 in the portion or portions where the desired undistorted three-dimensional pattern is intended for display and where the predistorted and printed three-dimensional pattern or image will appear after printing and prior to wearing sock 600, as shown for example in FIG. 6. Consistent with an embodiment, computing device 700 may take into account dimensional information from sock 600 shown in FIG. 6, such as distance measurements D1, D2, and D3, and height measurements H1 and H1. Computing device 700 may or may not use additional measurements, less measurements, images, three-dimensional mapping, or other techniques to gather data and other dimensional information from sock 600. For example, computing device 700 may also gather information as to the type of material comprising sock 600, how much the material will stretch or yield to externally applied forces, and surface texture, among other things. Such information, in whatever form and amount, may be used to aid in adequate and accurate predicting of the manifestation of a desired undistorted three-dimensional pattern or image on a surface of wearer's leg 500, taking into account any and all aspects of sock 600 prior to being placed on wearer's leg 500. Moreover, other factors like surface texture, material thickness, the amount of stretch, and other material properties of the article may be considered when producing the predistorted image. Likewise, external forces, ambient temperature, lighting conditions, color contrast, and other phenomena experienced by the article or imposed on the article may also be considered when producing the predistorted image.

Still referring to FIG. 8, and consistent with an embodiment, computing device 700 may also take into account geometric primitives, for example one or more three-dimensional geometric primitive objects, for calculating and mapping or displaying predistorted three-dimensional pattern 850, or for calculating and mapping or displaying undistorted three-dimensional pattern 750 shown in FIG. 7, or both. Such three-dimensional geometric primitive objects may be chosen from a sphere, a cube, a toroid, a cylinder, and a pyramid, and applied by computing device 700 in any number, orientation, manner, calculation, or algorithm in order to adequately and accurately depict either or both of predistorted three-dimensional pattern 850 and undistorted three-dimensional pattern 750. Any suitable mathematical algorithm, numerical method, or curve fitting technique may be used to construct or fine tune the predistorted image. Consistent with an embodiment, and by way of example only, computing device 700 may use at least a three-dimensional cylinder as a geometric primitive object in at least a portion of the calculation, mapping, or depiction of predistorted three-dimensional pattern 850 shown in FIG. 8. Such a cylinder may be used to approximate the surface of sock 910 on cylinder 900 as a regular three-dimensional object and as a substrate on which three-dimensional printing occurs.

Figure 9:
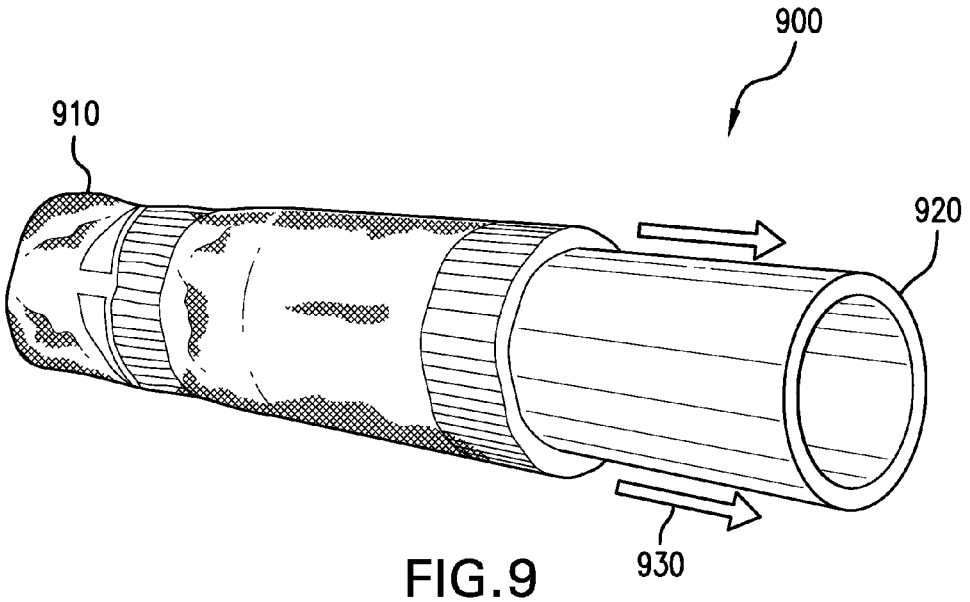
FIG. 9 shows a perspective view of a fabric sock being placed onto a cylinder in preparation for 3D printing, consistent with an embodiment of the disclosure.
Figure 10:
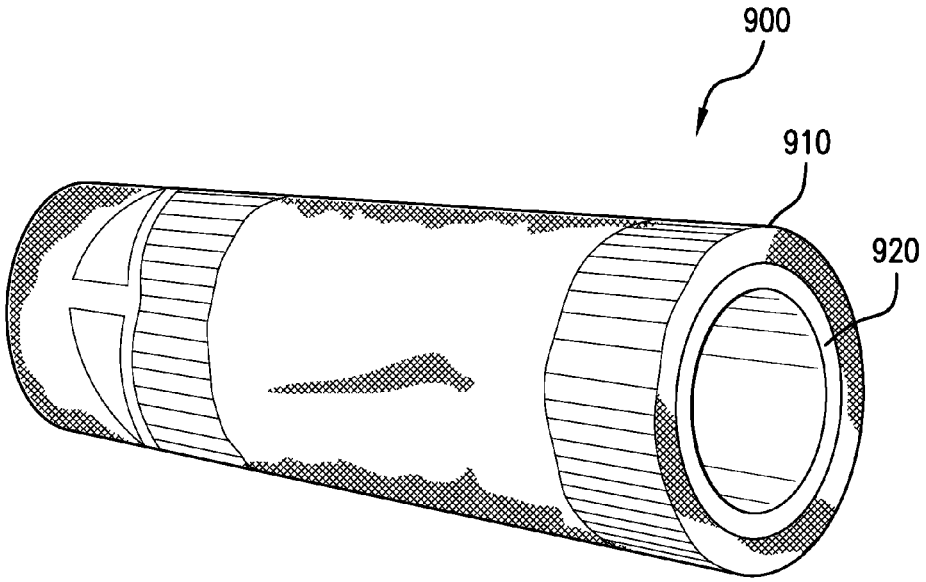
FIG. 10 shows a perspective view of a fabric sock in place on a cylinder and in preparation for 3D printing, consistent with an embodiment of the disclosure.

Consistent with an embodiment, FIGS. 9 and 10 show assembly of a printing substrate 900 on which three-dimensional printing of predistorted three-dimensional pattern 850 will occur. FIG. 9 shows substrate 900 during assembly, where sock 910 is placed or pulled over a three-dimensional cylinder 920 as depicted by motion 930. Three-dimensional objects other than a cylinder may be used underneath sock 910 in place of cylinder 920, and that cylinder 920 is shown for simplicity of description and ease of printing on a material such as sock 910. For example, if three-dimensional printing is desired on articles of apparel other than socks, a cylinder or one or more other three-dimensional geometric primitive objects may be chosen (e.g., a sphere, a cube, a toroid, or a pyramid) for placement of the articles of apparel prior to and during three-dimensional printing. FIG. 10 shows substrate 900 after assembly, where sock 910 is placed or pulled over a three-dimensional cylinder 920 and ready for insertion into 3D printer 1000.

The dimensional measurements described with reference to FIGS. 5 and 6 may vary based on the portion of the wearer's leg 500 measured and that this may affect the printing that may occur on sock 910 disposed on cylinder 920. Moreover, accurate manifestation of a desired undistorted three-dimensional pattern or image on a surface of a sock worn on wearer's leg 500, such as pattern 140 shown in FIG. 1, may be achieved by understanding one or more relationships between such dimensional measurements, and comparisons among dimensional measurements, taken from varied portions of the wearer's leg 500, sock 600, and sock 910 (disposed on cylinder 920) using computing device 700.

For example, printing of portions of predistorted three-dimensional pattern 850 may be understood in the context of printing arc lengths onto a cylinder, such as onto sock 910 disposed on cylinder 920. Multiple arcs, each having the same length, may be printed at one or more positions axially along sock 910 on cylinder 920. When sock 910 is removed from cylinder 920 and disposed on wearer's leg 500, the printed arc lengths may manifest arcs having different lengths at the corresponding axial positions of sock 910 on the wearer's leg 500, due to the irregular three-dimensional surface of wearer's leg 500.

In order to achieve accurate display of a desired undistorted three-dimensional pattern or image on a sock, such as sock 910 on a surface of wearer's leg 500, the arcs printed at one or more positions axially along sock 910 on cylinder 920 may have different lengths to account for different distortion (for example, stretching) of sock 910 when the sock is disposed on wearer's leg 500. For example, if a first portion of an undistorted three-dimensional pattern or image is desired for display on a sock at a wearer's ankle region, that ankle region may have a smaller arc length than a second portion of an undistorted three-dimensional pattern or image desired for display on a sock at a wearer's calf region. Therefore, printing of the corresponding predistorted three-dimensional pattern or image will take into account these different arc lengths in the predistortion process, for example, on computing device 700.

Referring back to the dimensional measurements discussed with reference to FIGS. 5 and 6, for example, arc lengths C1 and C2 may be different. Assume, for example, that it is desired to print two portions of a 3D feature having identical length at different axial positions on a sock, such as sock 910 on wearer's leg 500, corresponding to the locations of arc lengths C1 and C2, the arc lengths being different. In order to print these portions so that they display accurately on sock 910, at identical length, when disposed on wearer's leg 500, the corresponding arc lengths printed on sock 910 when disposed on cylinder 920 may not be equal, due to the fact that arc lengths C1 and C2, as measured on the wearer's leg, are different. That is, if arc length C1 is larger than arc length C2, the predistorted arc length printed on sock 910 disposed on cylinder 920 corresponding to arc length C1 will be smaller than the predistorted arc length printed on sock 910 disposed on cylinder 920 corresponding to arc length C2. Thus, in order to display a printed feature on a sock disposed on a wearer's calf and another feature of identical length on the sock at the wearer's ankle, the corresponding predistorted feature printed on the sock 910 at a position corresponding to the wearer's calf will be smaller than the corresponding predistorted feature printed on the sock 910 at a position corresponding to the wearer's ankle. This is because the feature located on the sock at the wearer's calf will undergo greater stretching than will the feature on the sock located at the wearer's ankle, when the sock is disposed on the wearer. This explanation is exemplary only, and not limiting of the types, designs, styles, or complexity of features that may be printed, or the relationships between the printed features and the corresponding display of those features on an article of clothing disposed on a portion of a wearer's body.

Figure 11:
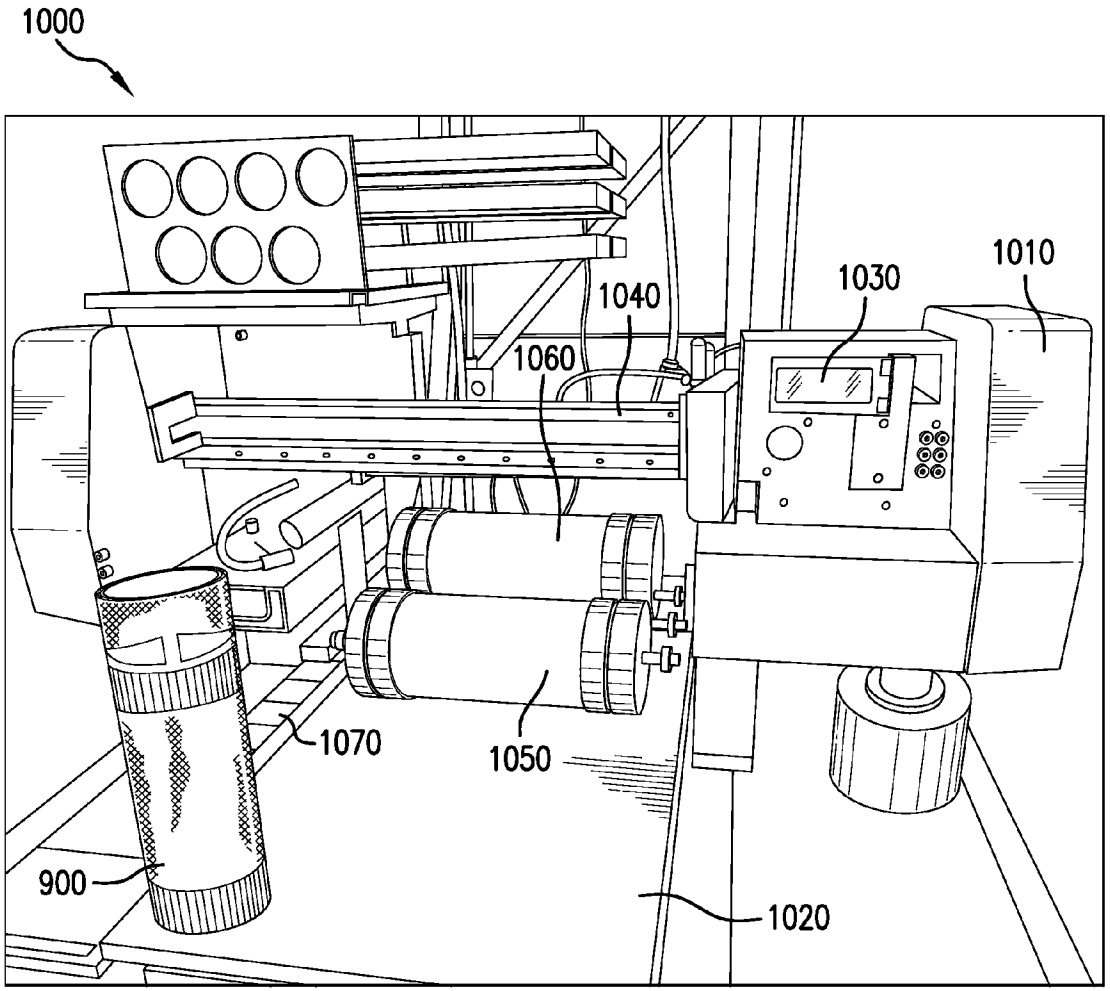
FIG. 11 shows a perspective view of a 3D printer device and the fabric sock-on-cylinder of FIG. 10, consistent with an embodiment of the disclosure.

As shown in FIG. 11, and consistent with an embodiment, 3D printer 1000 may comprise a 3D printer device housing 1010, a moveable base or tray 1020, one or more 3D printing heads 1030, one or more rails or scaffolds 1040, a first rotatable cylinder or drum 1050, a second rotatable cylinder or drum 1060, and a belt or chain 1070 for moving tray 1020 and drums 1050 and 1060. Printing material to be ejected from one or more 3D printing heads 1030 may be stored or supplied in housing 1010 or be provided from one or more sources external to 3D printer 1000. 3D printer 1000 may also include one or more lids (not shown) to cover or protect at least the one or more 3D printing heads 1030. Also shown in FIG. 11 is substrate 900, standing on end on tray 1020 for reference and comparison with the size of drums 1050 and 1060. 3D printer 1000 may comprise more components or less components than depicted in FIGS. 11-14.

Figure 12:
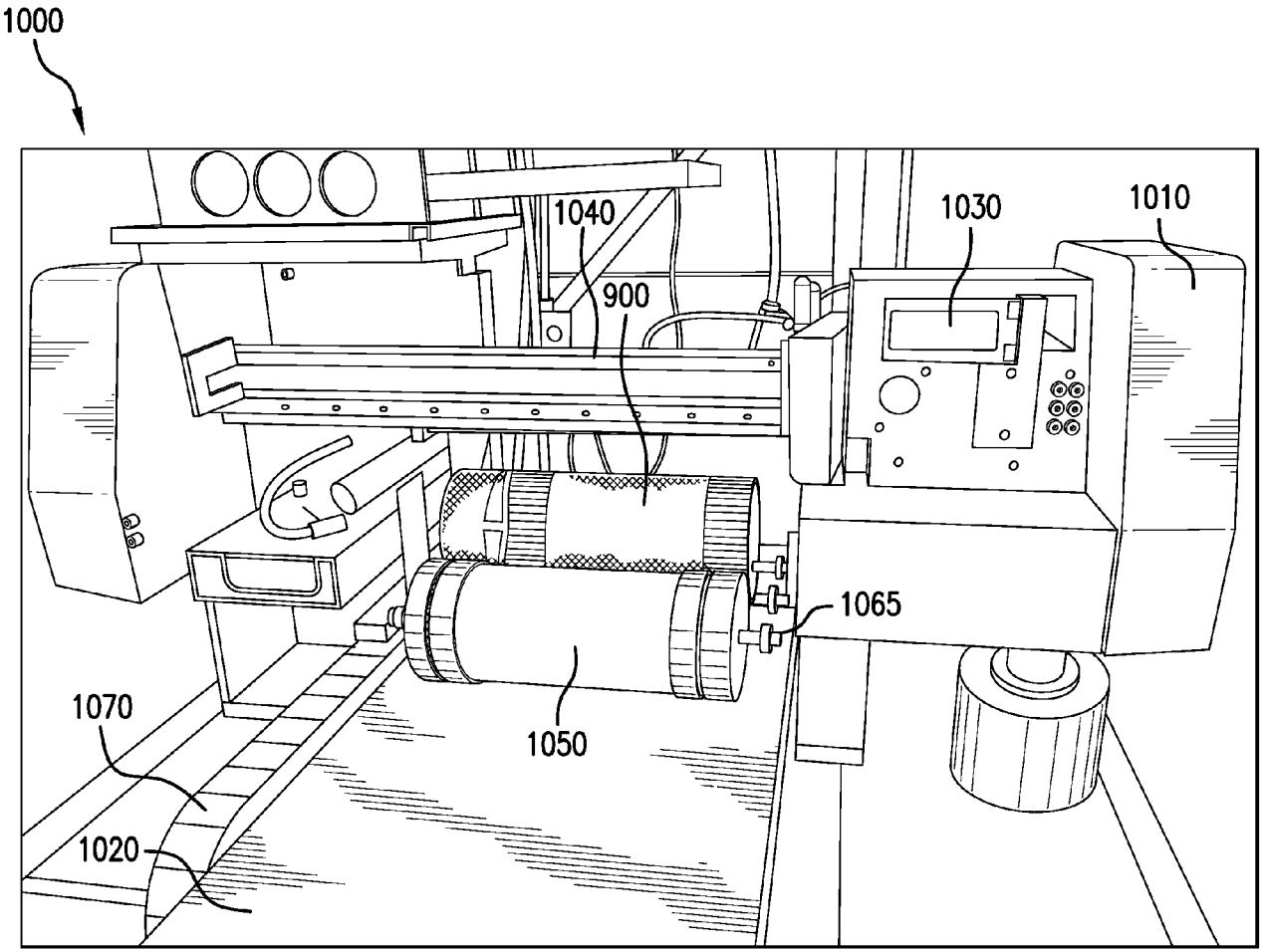
FIG. 12 shows a perspective view of the 3D printer device of FIG. 11 with the fabric sock-on-cylinder mounted for 3D printing, consistent with an embodiment of the disclosure.

As shown in FIG. 12, and consistent with an embodiment, substrate 900 may be placed above, and be cradled by, drum 1050 and drum 1060 (drum 1060 is not shown in FIG. 12 because it is obscured from view by substrate 900) in 3D printer 1000. Drums 1050 and 1060 may be held in a desired position, spacing, or alignment, by one or more pins or axles 1065. Substrate 900 may in turn be held in place by one or more additional pins or axles, by drums 1050 and 1060, or both, during 3D printing.

Figure 13:
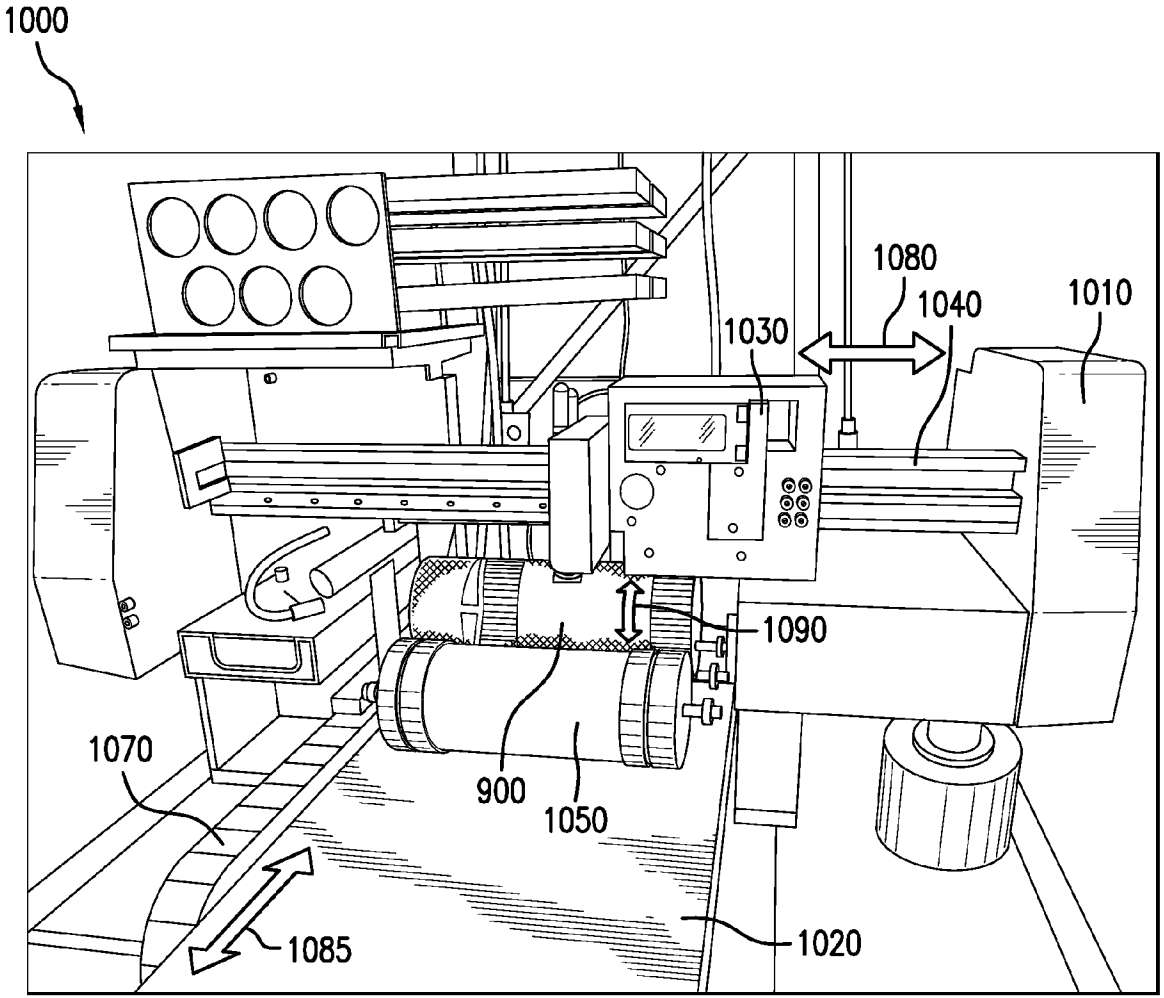
FIG. 13 shows a perspective view of the 3D printer device of FIG. 11 during 3D printing on the fabric sock-on-cylinder, consistent with an embodiment of the disclosure.

As shown in FIG. 13, and consistent with an embodiment, one or more 3D printing heads 1030 may move laterally back and forth along one or more rails or scaffolds 1040 as shown by arrow 1080. Such motion of one or more 3D printing heads 1030 can be driven by any known mechanism, such one or more motors or servos. Also consistent with an embodiment, and as shown in FIG. 13, tray 1020 may move laterally back and forth in a bidirectional manner perpendicular to the lateral motion of one or more 3D printing heads 1030 along one or more rails or scaffolds 1040. Such motion of tray 1020 may be accomplished by movement of belt or chain 1070 and is depicted by arrow 1085.

Still referring to FIG. 13, and consistent with an embodiment, substrate 900 may rotate in place as shown by arrow 1090. Rotation 1090 of substrate 900 may be accomplished by translation of rotational motion from either or both of drums 1050 and 1060, which in turn may rotate in place upon translation of lateral motion of tray 1020 moving in direction 1085. That is, movement of tray 1020 into and out of 3D printer 1000 may cause rotation of drums 1050 and 1060, which in turn may cause rotation of substrate 900 placed thereon. Rotation 1090 of substrate 900 may thus be used to present any portion of the surface of sock 910 to one or more 3D printing heads 1030 for printing. Rotation 1090, motion 1085, and motion 1080 may be controlled by 3D printer 1000, computing device 700, or any other known computer or actuating device or means, and may occur at any desired speed or direction to facilitate adequate and accurate printing onto sock 910.

Figure 14:
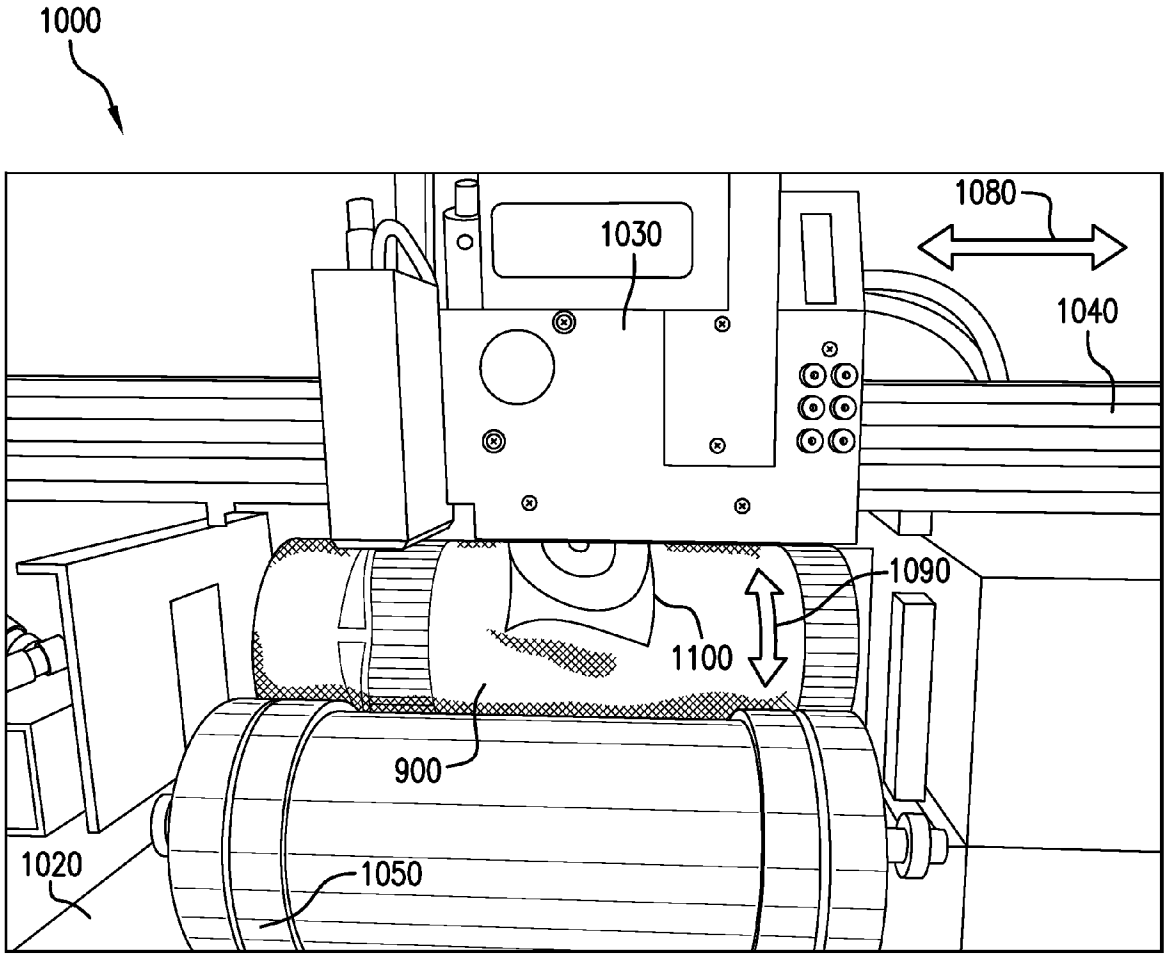
FIG. 14 shows a close-up perspective view of the 3D printer device of FIG. 11 during 3D printing on the fabric sock-on-cylinder, consistent with an embodiment of the disclosure.

As shown in FIG. 14, and consistent with an embodiment, one or more 3D printing heads 1030 may eject material (not shown) during printing onto sock 910 during movement laterally back and forth along one or more rails or scaffolds 1040 as shown by arrow 1080. In coordination with movement 1080, sock 910 may rotate as shown by rotation 1090 during printing of material from one or more 3D printing heads 1030. As sock 910 rotates, predistorted three-dimensional pattern 1100 may become visible on sock 910 as 3D printing progresses. Predistorted three-dimensional pattern 1100 may be printed in one or more sequences of 3D printing, with one or more passes of one or more 3D printing heads 1030, and for any suitable duration necessary to complete 3D printing.

Figure 15:
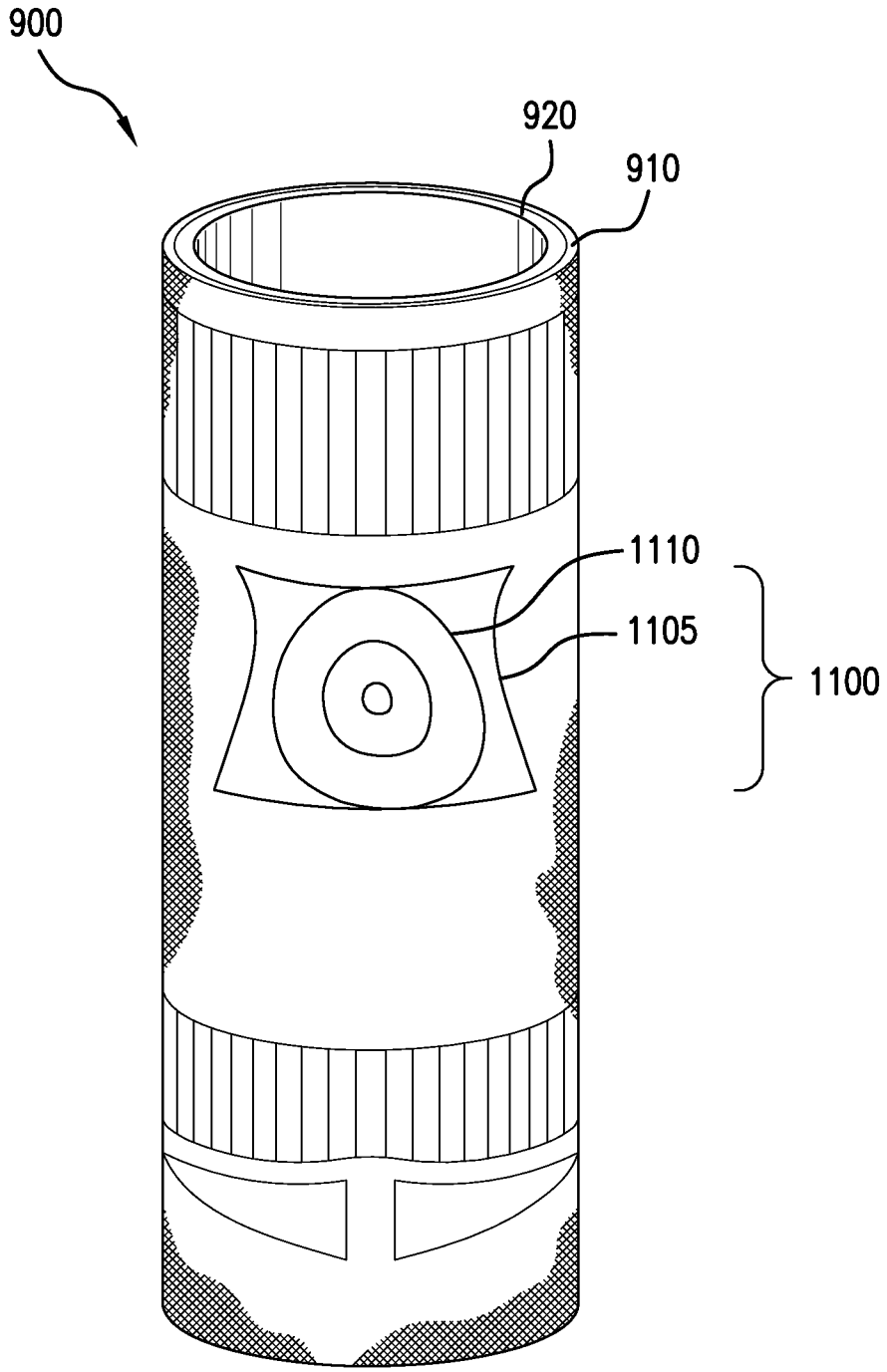
FIG. 15 shows a perspective view of the fabric sock-on-cylinder of FIG. 10 after completion of 3D printing of a predistorted 3D image onto the fabric, consistent with an embodiment of the disclosure.

As shown in FIG. 15, and consistent with an embodiment, substrate 900 may be removed from 3D printer 1000 upon completion of 3D printing. Upon inspection, printed predistorted three-dimensional pattern 1100 is visible on sock 910. Consistent with an embodiment, for example, printed predistorted three-dimensional pattern 1100 may comprise a predistorted rectangle 1105 and one or more concentric predistorted circles 1110. Printed predistorted three-dimensional pattern 1100 may correspond with predistorted three-dimensional pattern 850 displayed on computing device 700 as shown, for example, in FIG. 8. Still referring to FIG. 15, and consistent with an embodiment, printed predistorted three-dimensional pattern 1100 may be at least partially absorbed into a surface of sock 910. That is, for example, wetting and absorption, adhering, bonding, or curing of the printed predistorted three-dimensional pattern 1100 may be desirable and accomplished by 3D printer 1000.

Still referring to FIG. 15, for example, material forming printed predistorted three-dimensional pattern 1100 may be allowed to absorb into sock 910 for a predetermined amount of time after printing, or during printing and between passes of one or more 3D printing heads 1030. Such a predetermined amount of time will vary depending on the material used for forming printed predistorted three-dimensional pattern 1100 and the material comprising sock 910, as an absorption rate may be affected by the wettability or permeability of sock 910 to the printed material, the viscosity or temperature of the material during printing, and the pressure or speed at which the material is ejected from one or more 3D printing heads 1030 onto sock 910. Consistent with an embodiment, therefore, such a predetermined amount of time may be essentially immediately after ejection of material from one or more 3D printing heads 1030, or may be contemplated seconds or minutes thereafter. In addition, any number of layers of printed material or passes of one or more 3D printing heads 1030, or any number or combination of colors and materials, may be contemplated to complete printing of predistorted three-dimensional pattern 1100.

Figure 16:
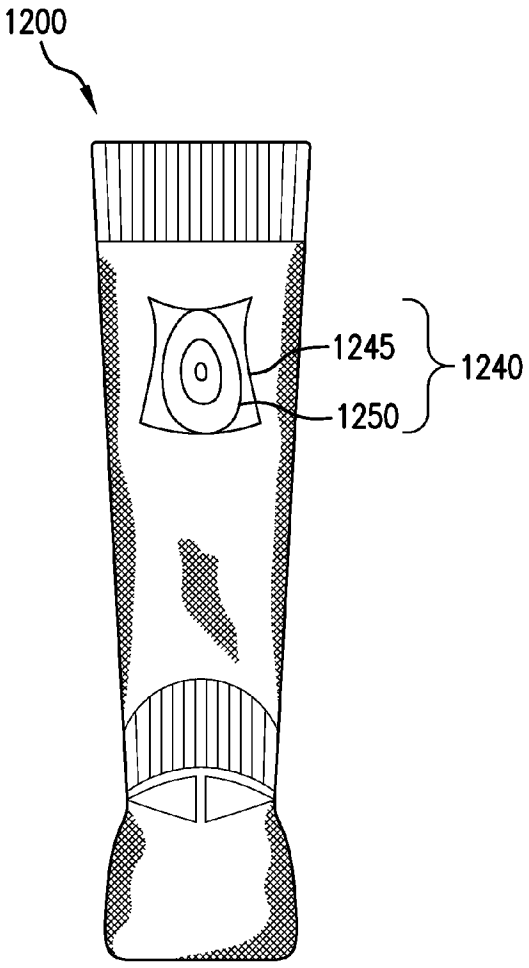
FIG. 16 shows an overhead perspective view of a fabric sock disposed flat and after printing of a predistorted 3D image, consistent with an embodiment of the disclosure.

As shown in FIG. 16, and consistent with an embodiment, printed sock 910 is now shown as printed sock 1200 after subsequent removal from cylinder 920. After removal from the simple three-dimensional shape of cylinder 920, printed sock 1200 is shown in the unworn and approximately two-dimensional and relaxed state of its material. Thus, upon removal from cylinder 920, the printed predistorted three-dimensional pattern 1100 may appear even more distorted than as it appeared on cylinder 920 in FIG. 15. Consistent with an embodiment, therefore, upon removal from cylinder 920, printed sock 1200 is shown with printed predistorted three-dimensional pattern 1240, which may thus manifest more distortion than that of the predistorted three-dimensional image 850 originally calculated and displayed on computing device 700 shown in FIG. 8. For example, printed predistorted three-dimensional pattern 1240 may comprise a predistorted rectangle 1245 and one or more concentric predistorted circles 1250, having respectively greater visible distortion than predistorted rectangle 1105 and one or more concentric predistorted circles 1110 shown in FIG. 15. Again, this is because the fabric of sock 1200 may relax and shrink after release from its stretched state as sock 910 around cylinder 920. This additional distortion will have been accounted for by computing device 700 in step 420 described above, such that the printed image or pattern to be displayed on the sock when worn will have no apparent distortion.

Figure 17:
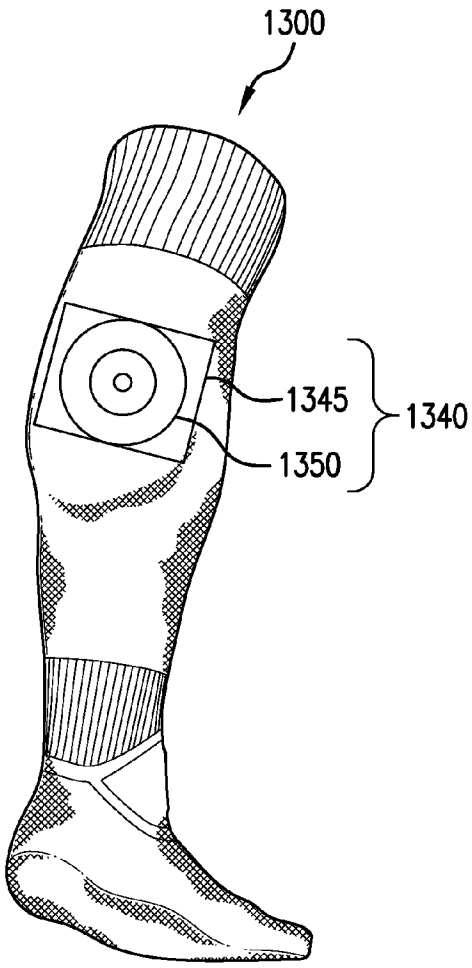
FIG. 17 shows a perspective view of the fabric sock of FIG. 16 on a wearer and having an undistorted 3D image printed thereon, consistent with an embodiment of the disclosure.

As shown in FIG. 17, and consistent with an embodiment, printed sock 1200 may be worn and is now depicted as printed sock 1300. Printed sock 1300 may include undistorted three-dimensional printed pattern or design 1340, similar to pattern or design 140 shown in FIG. 1. Printed pattern or design 1340 may thus correspond with desired undistorted three-dimensional pattern or image 750 for display or manifestation on any desired irregular three-dimensional surface, as calculated and designed on computing device 700 shown and described with reference to FIG. 7. Again, pattern 1340, while shown over the wearer's calf muscle region in FIG. 17, may be located on any region, or multiple regions, including any or all of the four general portions of apparel 100 described with reference to FIG. 1. Pattern 1340 is shown for simplicity purposes in FIG. 17 as a 3D depiction comprising a rectangle 1345 comprising an inset arrangement of one or more circles 1350, displayed without distortion on the wearer's calf on printed sock 1300. Moreover, pattern 1340, while shown in FIG. 17 as rectangle 1345 and circles 1350, may instead comprise any desired image, shape, or pattern, such as team logos, national flags, designs, or any other identifying or individualizing characteristics desired by the wearer. That is, pattern 1340 may be simply one exemplary depiction useful for purposes of description in this disclosure, and is not restrictive of the type or style of design to be printed. Consistent with an embodiment, however, and contrary to what is known in the art, pattern 1340 manifests itself in an undistorted manner on sock 1300 when worn on the irregular three-dimensional shape of the wearer and is depicted as such in FIG. 17. Thus, pattern 1340 shown in FIG. 17 appears recognizable and without distortion despite the nonuniform stretching of various portions of sock 1300 upon wearing, with or without underlying padding or protective materials previously described.

Consistent with an embodiment, and still referring to FIG. 17, pattern 1340 may be a printed material applied to sock 1300, and may comprise any printed material, including for example an ink, a dye, a resin, an acrylic, a polymer, a thermoplastic material, a thermosetting material, a light-curable material, or combinations thereof. Also consistent with an embodiment, pattern 1340 may be a printed material applied to sock 1300 in one or more layers over a sequence of depositions of material to any desired thickness, and may or may not include a filler material to impart a strengthening or aesthetic aspect to pattern 1340. For example, pattern 1340 may comprise any printed material designed to impart any desired color, colors, and color patterns or transitions, and may include any materials such as metallic or plastic particles or shavings, or any other powdered mineral, metal, or plastic, to customize the hardness, strength, or elasticity of pattern 1340 depending on desired properties. Consistent with an embodiment, pattern 1340 may thus simply be a printed dye, or it may be a composite material printed onto sock 1300.

Figure 18:
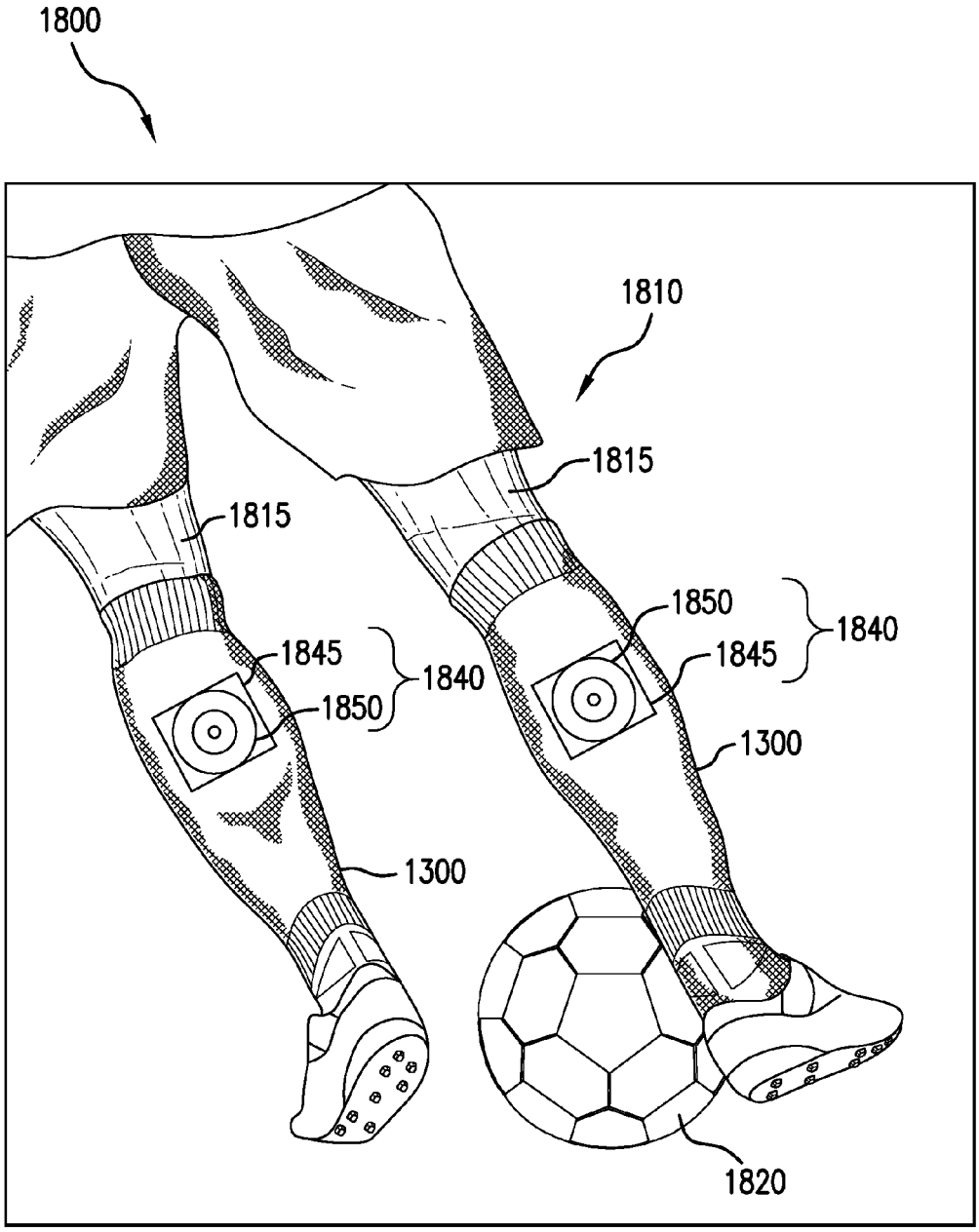
FIG. 18 shows a perspective view of fabric socks on an exemplary athlete during use and while having an undistorted depiction of a 3D image printed thereon, consistent with an embodiment of the disclosure.

As shown in FIG. 18, and consistent with an embodiment, image 1800 is shown of part of an exemplary athlete, such as soccer player 1810, in an action state of kicking a soccer ball 1820. Soccer player 1810 is depicted wearing printed socks 1300 on each of legs 1815. Consistent with an embodiment, printed undistorted three-dimensional pattern or image 1840 is visible on socks 1300 on each of the irregular three-dimensional surfaces of legs 1815. For example, similar to the description above referring to FIG. 17, FIG. 18 depicts printed pattern or design 1840, which may also correspond with desired undistorted three-dimensional pattern or image 750, as calculated and designed on computing device 700 shown and described with reference to FIG. 7. Again, pattern 1840, while shown over the wearer's calf muscle region on legs 1815 in FIG. 18, may alternatively be located on any region, or multiple regions, including any or all of the four general portions of apparel 100 described with reference to FIG. 1. Pattern 1840 is shown for simplicity purposes in FIG. 18 as a 3D depiction comprising a rectangle 1845 and an inset arrangement of one or more circles 1850, displayed without distortion on the wearer's calf on printed sock 1300. Moreover, pattern 1840, while shown in FIG. 18 as rectangle 1845 and circles 1850, may instead comprise any desired image, shape, or pattern, such as team logos, national flags, designs, or any other identifying or individualizing characteristics desired by the wearer. That is, pattern 1840 may be simply one exemplary depiction useful for purposes of description in this disclosure, and is not restrictive of the type or style of design to be printed. Consistent with an embodiment, however, and contrary to what is known in the art, pattern 1840 manifests itself in an undistorted manner on sock 1300 when worn on the irregular three-dimensional shape of the legs 1815 of soccer player 1810, and is depicted as such in FIG. 18. Thus, pattern 1840 shown in FIG. 18 appears recognizable and without distortion despite the nonuniform stretching of various portions of sock 1300 upon wearing, with or without underlying padding or protective materials previously described.

Still referring to FIG. 18, and consistent with an embodiment, the size and shape of legs 1815 may vary considerably from person to person, and that the type, style, and construction of socks 1300 may vary considerably from person to person, and from sport to sport. Thus, consistent with an embodiment, apparel printed consistent with embodiments of this disclosure may be customized in both design, implementation, and printing on an individualized basis or on a mass market basis. For example, individual athletes, such as soccer player 1810 shown in part in FIG. 18, may have measurements and other dimensional information gathered from legs 1815, or any other part of the body, where the desired printed undistorted three-dimensional pattern 1840 is intended for display. Also for example, as shown and described with reference to FIGS. 5 and 6, one or more measurements may be taken from wearer's legs 1815, such as distance measurements D1, D2, and D3, height measurements H1 and H2, and curvature measurements C1 and C2 shown in FIG. 5, and additional measurements may be taken from sock 1300 in the unworn state, such as shown and described with reference to FIG. 6. Additional measurements, less measurements, images, three-dimensional mapping, or other techniques may or may not be used to gather data and other dimensional information from wear's legs 1815 to collect fully customizable and individualized information for design and printing of socks 1300. Such information, in whatever form and amount, may be used to aid in adequate and accurate predicting of the manifestation of a desired undistorted three-dimensional pattern or image on a surface of wearer's legs 1815, taking into account any and all three-dimensional surface irregularities and asymmetries that may be present thereon.

Thus, with reference to FIG. 18, and consistent with an embodiment, soccer player 1810 may engage a manufacturer or other party, such as a proprietor, retailer, or any other entity, to order and have manufactured fully customized and individualized apparel items, for example, printed socks 1300, using the methods and systems described in this disclosure.

Figure 19:
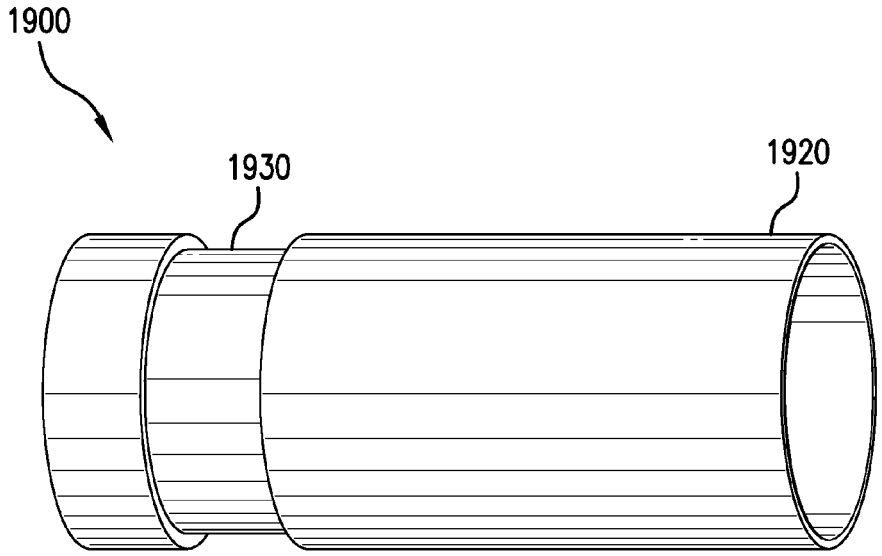
FIG. 19 shows a perspective view of a cylinder for use in a 3D printing device and having a plurality of diameters taken along a length direction, consistent with an embodiment of the disclosure.
Figure 20:
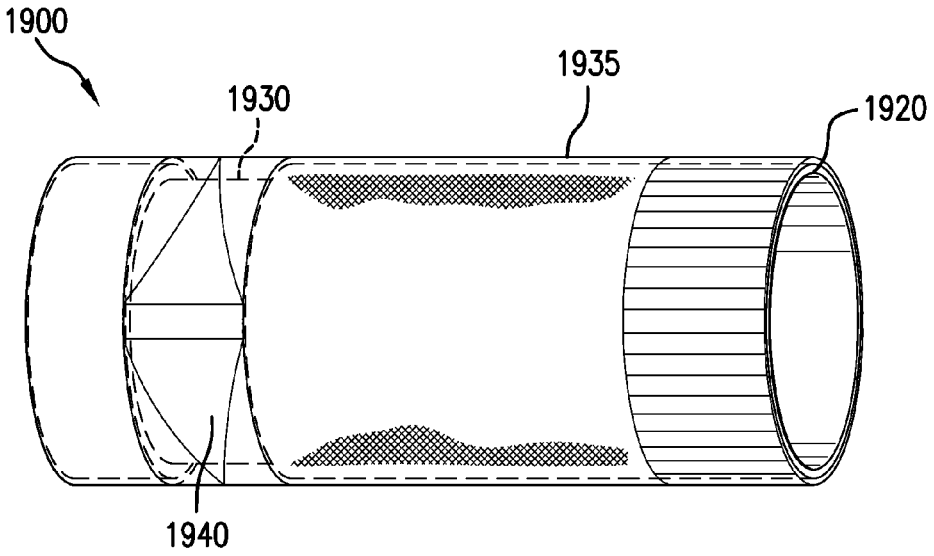
FIG. 20 shows a perspective view of a fabric sock having varying fabric thickness in place on the cylinder of FIG. 19 and in preparation for 3D printing, consistent with an embodiment of the disclosure.

With reference to FIGS. 19 and 20, and consistent with an embodiment, items of like apparel may vary considerably in design, shape, thickness, materials, etc. For example, socks may vary considerably in design, thickness, or construction, depending on the intended use of the apparel. For example, as described earlier with reference to FIG. 1, sock 100 may have four generally described sections, of which the area percentage of each section may vary according to the design and intended use of the apparel without departing from the scope and spirit of the disclosure. For example, one or more of these four general portions of sock 100 may comprise knit material of varying thickness, stretchiness, or strength, and may also comprise padded regions. For example, sock 100 may include one or more pads, such as ankle pad 135, which may comprise a thicker portion of fabric designed to protect one or more regions of the wearer's body such as ankle portion 125. Consistent with an embodiment, therefore, one may desire to print customized and undistorted three-dimensional patterns or images on articles of apparel that may have uneven, irregular surfaces, or surfaces having nonuniform thickness throughout.

As shown in FIG. 19, and consistent with an embodiment, therefore, modified cylinder 1900 may accommodate articles of apparel having nonuniform features, such that these articles of apparel may be subject to printing according to the disclosed methods and systems. Modified cylinder 1900 thus may have a portion of its length comprising a first outer diameter 1920, similar to the diameter of cylinder 920 described with reference to FIG. 9. Modified cylinder 1900, however, may also have one or more portions comprising a different diameter, such as second diameter 1930. As depicted in FIG. 19, second diameter 1930 is smaller than first diameter 1920. Diameters 1920 and 1930, however, may vary in any manner to accommodate any apparel desired for printing consistent with the disclosed embodiments. For example, modified cylinder 1900 may contain multiple regions of differing diameter, or regions of complex shapes either protruding from, or inset into, the cylinder.

As shown in FIG. 20, and consistent with an embodiment, modified cylinder 1900 depicted in FIG. 19 is shown covered with an exemplary sock 1935. For illustration purposes only, sock 1935 is shown in a transparent manner to better depict portions of sock 1935 over portions of modified cylinder 1900 having different diameters. For example, similar to the earlier description with reference to FIG. 1, sock 1935 may include one or more pads, such as ankle pad 1940, which may comprise a thicker portion of fabric designed to protect one or more regions of the wearer's body such as the wearer's ankle. As shown in FIG. 20, sock 1935 may comprise such thicker regions consistent with ankle pad 1940. Thus, sock 1935 may be placed over modified cylinder 1900 to present a substantially uniform and simple three-dimensional surface for printing consistent with the disclosed methods and systems.

Figure 21:
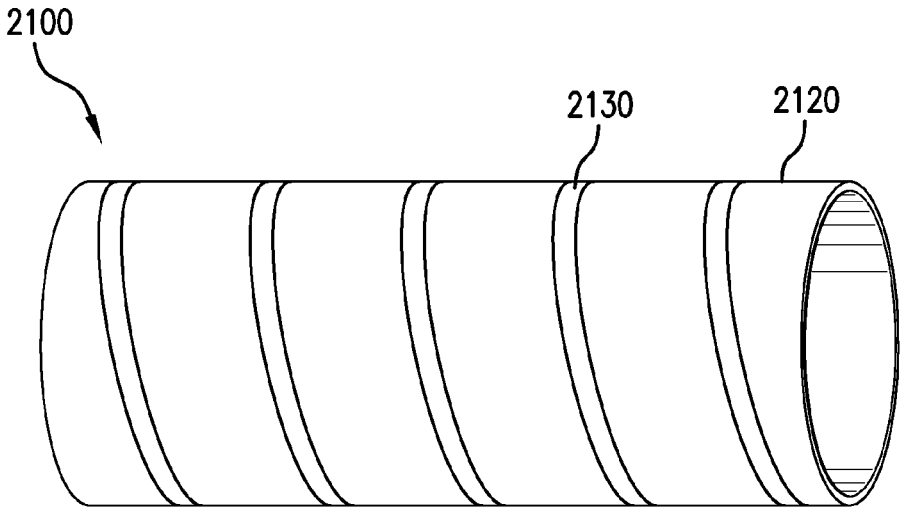
FIG. 21 shows a perspective view of a cylinder for use in a 3D printing device and having a wound arrangement of at least one heating element thereon, consistent with an embodiment of the disclosure.
Figure 22:
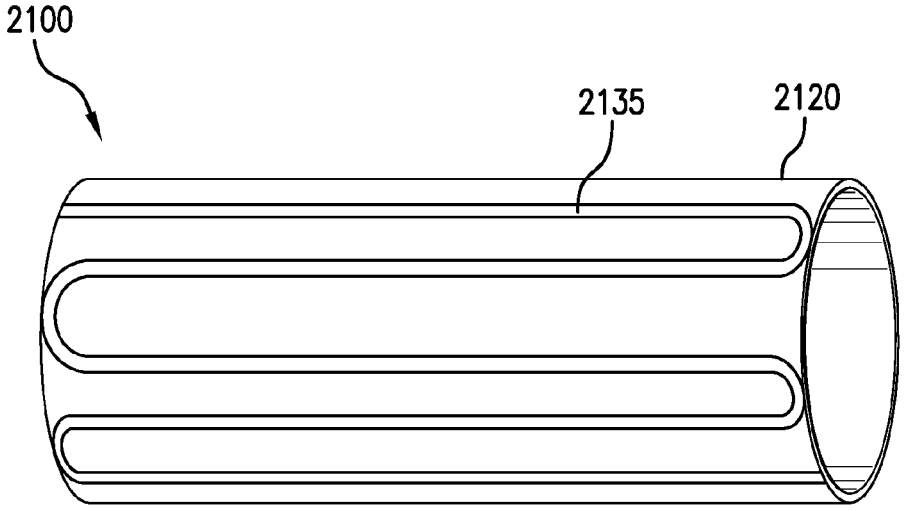
FIG. 22 shows a perspective view of a cylinder for use in a 3D printing device and having a serpentine arrangement of at least one heating element thereon, consistent with an embodiment of the disclosure.

With reference to FIGS. 21 and 22, and consistent with an embodiment, different materials may be printed on the articles of apparel. For example, as described earlier, printed material may comprise any printed material, including for example an ink, a dye, a resin, an acrylic, a polymer, a thermoplastic material, a thermosetting material, a light-curable material, or combinations thereof. Also consistent with an embodiment, printed material may be applied in one or more layers over a sequence of depositions of material to any desired thickness, and may or may not include a filler material to impart a strengthening or aesthetic aspect. For example, printed material may impart any desired color, colors, and color patterns or transitions, and may include any materials such as metallic or plastic particles or shavings, or any other powdered mineral, metal, or plastic, to customize hardness, strength, or elasticity depending on desired properties. Further, the printed material may be absorbed into, adhered to, or bonded to the article of apparel. Thus, printing of different materials may be assisted with or aided by additional modifications to cylinder 1900.

As shown in FIG. 21, and consistent with an embodiment, modified cylinder 2100 may have one or more outer diameters 2120 and further comprise one or more wound heating elements 2130 applied thereon. Wound heating elements 2130 may comprise heating tapes, for example, and may be substantially flush with the surface of cylinder diameter 2120. Alternatively, cylinder 2100 may have modifications made to its diameter to accommodate thicker wound heating elements 2130 without having elements 2130 protrude beyond the surface level of diameter 2120. Modified cylinder 2100 depicted in FIG. 21 may have any configuration of heating elements beyond the exemplary configurations described here, and that the heating of such heating elements made aid or assist in the printing process according to the disclosed methods and systems.

Similarly, as shown in FIG. 22, and consistent with an embodiment, modified cylinder 2100 may have one or more outer diameters 2120 and further comprise one or more serpentine heating elements 2135 applied thereon. Serpentine heating elements 2135 may comprise heating tapes, for example, and may be substantially flush with the surface of cylinder diameter 2120. Alternatively, cylinder 2100 may have modifications made to its diameter to accommodate thicker serpentine heating elements 2135 without having elements 2135 protrude beyond the surface level of diameter 2120. Modified cylinder 2100 depicted in FIG. 22 may have any configuration of heating elements beyond the exemplary configurations described here, and that the heating of such heating elements made aid or assist in the printing process according to the disclosed methods and systems.

While various embodiments have been described, the description is intended to be exemplary, rather than limiting, and it will be apparent to those of ordinary skill in the art that many more embodiments and implementations are possible that are within the scope of the disclosure. It is intended that all such additional systems, methods, features and advantages be included within this description and this summary, be within the scope of the disclosure, and be protected by the following claims.

What is claimed is:

1. A method of three-dimensional printing onto an article of apparel, comprising:

receiving an undistorted three-dimensional pattern for display on the article, the undistorted three-dimensional pattern configured for placement on an irregular three-dimensional surface;

creating a predistorted three-dimensional pattern from the undistorted three-dimensional pattern for printing onto a simple three-dimensional shaped object;

receiving the predistorted three-dimensional pattern in a three-dimensional printing system; and printing the predistorted three-dimensional pattern onto the article.

2. The method according to claim 1, wherein the irregular three-dimensional surface comprises a surface chosen from a portion of a human body.

3. The method according to claim 1, wherein the creating comprises receiving and manipulating information chosen from dimensional information, geometric information, and assumptions.

4. The method according to claim 3, wherein the creating further comprises using the received and manipulated information to prepare the predistorted three-dimensional pattern using at least one geometric primitive chosen from a sphere, a cube, a toroid, a cylinder, and a pyramid.

5. The method according to claim 1, wherein the simple three-dimensional shaped object comprises a geometric primitive shaped object chosen from a sphere, a cube, a toroid, a cylinder, and a pyramid.

6. The method according to claim 1, wherein the predistorted three-dimensional pattern changes to the undistorted three-dimensional pattern when the article is disposed on the irregular three-dimensional surface.

7. The method according to claim 1, further comprising displaying the undistorted three-dimensional pattern on a portion of a human body.

8. The method according to claim 1, wherein the article of apparel is chosen from a textile, a natural fabric, a synthetic fabric, a knit material, a woven material, a nonwoven material, a natural fiber, a synthetic fiber, cotton, wool, linen, silk, nylon, spandex, polyester, rayon, polypropylene, a mesh, a leather, a synthetic leather, a polymer, a rubber, a foam, clothing, footwear, hats, caps, shirts, jerseys, jackets, socks, shorts, pants, undergarments, athletic support garments, gloves, wrist/arm bands, sleeves, headbands, and combinations of any of these materials.

9. The method according to claim 1, wherein at least a portion of the article has at least one asymmetrical surface when disposed on the irregular three-dimensional surface.

10. The method according to claim 1, wherein the article is a substrate on which the printing occurs.

11. The method according to claim 1, wherein the printed pattern is printed from a material chosen from an ink, a dye, a resin, an acrylic, a polymer, a thermoplastic material, a thermosetting material, and a light-curable material.

12. A method of three-dimensional printing onto an article of apparel, comprising:

receiving an undistorted three-dimensional pattern for display on the article, the undistorted three-dimensional pattern configured for placement on at least a portion of a human body;

creating a predistorted three-dimensional pattern from the undistorted three-dimensional pattern for printing onto a three-dimensional geometric primitive object;

receiving the predistorted three-dimensional pattern in a three-dimensional printing system; and printing the predistorted three-dimensional pattern onto the article.

13. The method according to claim 12, wherein the creating comprises receiving and manipulating information chosen from dimensional information, geometric information, and assumptions.

14. The method according to claim 13, wherein the creating further comprises using the received and manipulated information to prepare the predistorted three-dimensional pattern.

15. The method according to claim 12, wherein the three-dimensional geometric primitive object is chosen from a sphere, a cube, a toroid, a cylinder, and a pyramid.

16. The method according to claim 12, wherein the predistorted three-dimensional pattern changes to the undistorted three-dimensional pattern when the article is disposed on the at least a portion of the human body.

17. The method according to claim 12, further comprising displaying the undistorted three-dimensional pattern on the at least a portion of the human body.

18. The method according to claim 12, wherein the article of apparel is chosen from a textile, a natural fabric, a synthetic fabric, a knit material, a woven material, a nonwoven material, a natural fiber, a synthetic fiber, cotton, wool, linen, silk, nylon, spandex, polyester, rayon, polypropylene, a mesh, a leather, a synthetic leather, a polymer, a rubber, a foam, clothing, footwear, hats, caps, shirts, jerseys, jackets, socks, shorts, pants, undergarments, athletic support garments, gloves, wrist/arm bands, sleeves, headbands, and combinations of any of these materials.

19. The method according to claim 12, wherein at least a portion of the article has at least one asymmetrical surface when disposed on the at least a portion of the human body.

20. The method according to claim 12, wherein the article is a substrate on which the printing occurs.

21. The method according to claim 12, wherein the printed pattern is printed from a material chosen from an ink, a dye, a resin, an acrylic, a polymer, a thermoplastic material, a thermosetting material, and a light-curable material.

22. A method of three-dimensional printing onto an article of apparel, comprising:

receiving, in a computing device, an undistorted three-dimensional pattern for display on the article, the undistorted three-dimensional pattern configured for placement on at least a portion of a human body;

creating, using the computing device, a predistorted three-dimensional pattern from the undistorted three-dimensional pattern for printing onto a three-dimensional geometric primitive object;

receiving the predistorted three-dimensional pattern to a three-dimensional printing system; and printing the predistorted three-dimensional pattern onto the article.

23. A method of three-dimensional printing onto an article of apparel, comprising:

receiving, in a computing device, an undistorted three-dimensional pattern for display on the article, the undistorted three-dimensional pattern configured for placement on at least a portion of a human body, at least a portion of the undistorted three-dimensional pattern having at least a first arc length;

creating, using the computing device, a predistorted three-dimensional pattern from the undistorted three-dimensional pattern for printing onto a three-dimensional geometric primitive object, at least a portion of the predistorted three-dimensional pattern having at least a second arc length;

receiving the predistorted three-dimensional pattern in a three-dimensional printing system; and printing at least a portion of the second arc length of the predistorted three-dimensional pattern onto the article disposed on the three-dimensional geometric primitive object.

24. The method according to claim 23, wherein the at least a portion of the undistorted three-dimensional pattern has at least a third arc length, and wherein the at least a portion of the predistorted three-dimensional pattern has at least a fourth arc length.

25. The method according to claim 24, wherein when the third arc length is substantially equal in length to the first arc length, the second arc length is shorter than the fourth arc length.

26. The method according to claim 25, further comprising printing the at least a portion of the second arc length and printing at least a portion of the fourth arc length, the printed portion of the second arc length being shorter in length than the printed portion of the fourth arc length, wherein the printed portion of second arc length corresponds to a first displayed portion of first arc length, and the printed portion of the fourth arc length corresponds to a second displayed portion of the third arc length.

27. A system for three-dimensional printing onto an article of apparel, comprising:

a three-dimensional printing device; and at least one computer system, wherein the three-dimensional printing device is in direct communication with the at least one computer system, wherein the at least one computer system receives an undistorted three-dimensional pattern for display on the article, the undistorted three-dimensional pattern configured for placement on at least a portion of a human body, at least a portion of the undistorted three-dimensional pattern having at least a first arc length, wherein the at least one computer system creates a predistorted three-dimensional pattern from the undistorted three-dimensional pattern for printing onto a three dimensional geometric primitive object, at least a portion of the predistorted three-dimensional pattern having at least a second arc length, wherein the three-dimensional printing device comprises a rotatable cylinder for receiving the article, and at least one printing head for printing onto the article, and wherein the three-dimensional printing device prints at least a portion of the second arc length of the predistorted three-dimensional pattern onto the article disposed on the three-dimensional geometric primitive object.

* * * * *